US010580396B1

(12) United States Patent
Quigley et al.

(10) Patent No.: US 10,580,396 B1
(45) Date of Patent: Mar. 3, 2020

(54) ACOUSTICALLY STIFF WALL

(71) Applicant: The United States of America as represented by the Secretary of the Navy, Arlington, VA (US)

(72) Inventors: James M. Quigley, Glenside, PA (US); Christopher T. Buckingham, Haddon Heights, NJ (US)

(73) Assignee: The United States of America as represented by the Secretary of the Navy, Arlington, VA (US)

( * ) Notice: Subject to any disclaimer, the term of this patent is extended or adjusted under 35 U.S.C. 154(b) by 231 days.

(21) Appl. No.: 15/481,766

(22) Filed: Apr. 7, 2017

(51) Int. Cl.

| | |
|---|---|
| ***G10K 11/175*** | (2006.01) |
| ***G10K 11/172*** | (2006.01) |
| ***E04B 1/82*** | (2006.01) |
| ***G10K 11/162*** | (2006.01) |
| ***E04B 1/84*** | (2006.01) |
| *G10K 11/16* | (2006.01) |
| *E04B 1/74* | (2006.01) |

(52) U.S. Cl.
CPC ..... *G10K 11/175* (2013.01); *E04B 1/8209* (2013.01); *E04B 1/8409* (2013.01); *G10K 11/162* (2013.01); *E04B 2001/742* (2013.01); *E04B 2001/829* (2013.01); *E04B 2001/8423* (2013.01)

(58) Field of Classification Search
CPC ..... G10K 11/175; G10K 11/172; E04B 1/82; E04B 1/8227; E04B 1/8236; E04B 1/8409; E04B 2001/8263; E04B 2001/829; E04B 2001/8447; E04B 2001/8452; E04B 2001/8423
See application file for complete search history.

(56) References Cited

U.S. PATENT DOCUMENTS

| | | | | | |
|---|---|---|---|---|---|
| 3,382,947 | A * | 5/1968 | Biggs | E04B 1/994 | 181/30 |
| 3,404,498 | A * | 10/1968 | Espinoza | E04B 2/7411 | 181/295 |
| 3,590,354 | A * | 6/1971 | Shiflet | E04B 1/994 | 181/30 |
| 3,783,968 | A * | 1/1974 | Derry | E01F 8/0052 | 181/210 |
| 4,094,379 | A * | 6/1978 | Steinberger | E04B 1/994 | 181/284 |

(Continued)

*Primary Examiner* — Edgardo San Martin
(74) *Attorney, Agent, or Firm* — Mark J. Rosen

(57) ABSTRACT

An exemplary inventive acoustic wall panel includes a pair of congruent flat rectangular plates and a housing. The two plates adjoin at their respective vertical edges to form an angle Ø between the two plates, wherein 90°≤Ø<180°. Each plate has a material characteristic relating to acoustic reduction through the plate. Design of an inventive wall panel includes selection of the angle Ø and the respective plate materials, with an objective of producing counteractive acoustic vibratory motions in the two plates in response to sound waves impinging upon the inventive wall panel. Acoustic vibratory motion is induced in each plate whereby the respective vibratory motions tend to oppose each other, thereby reducing sound transmission across the inventive wall panel. The housing lends support to the two attached plates and facilitates connection of the inventive wall panel to another inventive wall panel or to a different structure.

17 Claims, 18 Drawing Sheets

(56) References Cited

U.S. PATENT DOCUMENTS 4,226,299 A * 10/1980 Hansen ..... E04B 1/86 181/210
4,362,222 A * 12/1982 Hellstrom ..... E04B 1/994 181/287
4,373,608 A * 2/1983 Holmes ..... G10K 11/172 181/202
4,605,093 A * 8/1986 Karlen ..... E04B 1/8218 181/286
4,805,734 A 2/1989 Mast
4,875,312 A 10/1989 Schwartz
5,141,073 A * 8/1992 Pelonis ..... E04B 1/8209 181/295
5,623,130 A * 4/1997 Noxon ..... E04B 1/8209 181/30
5,627,897 A 5/1997 Gagliardini et al.
6,170,603 B1 1/2001 Bachmann et al.
6,173,806 B1 * 1/2001 Ito ..... E01F 8/0094 181/206
6,209,680 B1 4/2001 Perdue
6,305,492 B1 * 10/2001 Oleiko ..... E01F 8/0017 181/210
6,446,751 B1 * 9/2002 Ahuja ..... A47H 23/02 181/280
6,907,736 B2 6/2005 Ohnishi et al.
7,059,093 B2 6/2006 Akers
7,178,630 B1 2/2007 Perdue
7,565,951 B1 7/2009 Perdue
D723,718 S 3/2015 Gray
9,322,165 B2 4/2016 Luhtala
10,119,269 B2 * 11/2018 Perdue ..... E04B 1/994
2006/0124388 A1 6/2006 Pompei
2006/0179760 A1 8/2006 Burg
2008/0230308 A1 9/2008 Steiner et al.
2010/0198426 A1 * 8/2010 Kondo ..... G10K 11/28 700/302
2013/0001011 A1 * 1/2013 Panosh ..... G10K 11/16 181/287
2014/0260045 A1 9/2014 Near
2016/0160458 A1 6/2016 Oeler

* cited by examiner

| Sound Transmission Class of Materials | STC |
|---|---|
| 1 lb. density barrier material | 26 |
| 1 lb. density transparent curtain | 26 |
| 5/8" Gypsum wallboard | 30 |
| 3/16" Steel wall | 31 |
| 2" fiberglass curtain with 1 lb. barrier | 29 |
| 2" thick metal panel (solid and perforated) | 35 |
| 4" thick metal panel (solid and perforated) | 41 |
| 12" thick concrete | 53 |
| 3/8" plasterboard | 26 |
| 22 gauge steel | 25 |
| Solid core wood door, closed | 27 |
| Concrete block wall, unpainted | 44 |

FIG. 2

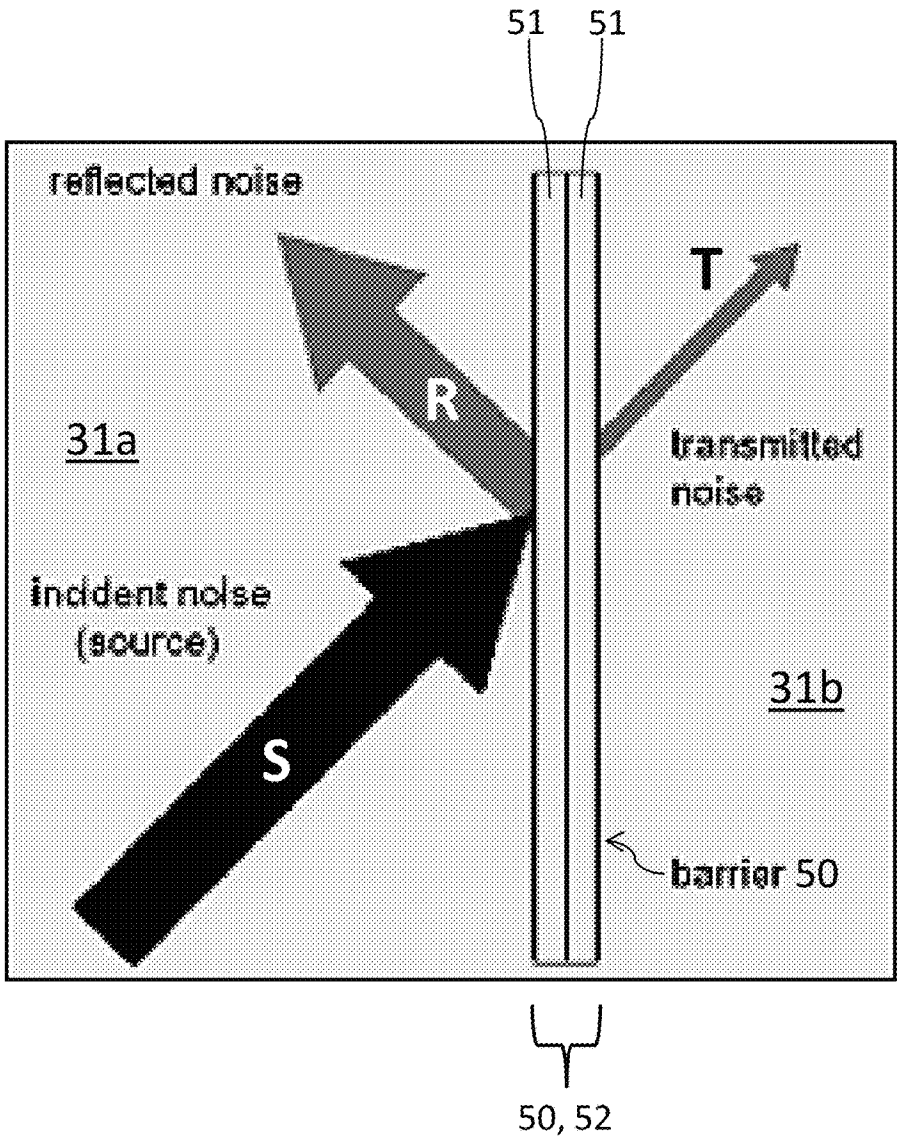

FIG. 1

ACOUSTICALLY STIFF WALL

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The present invention relates to acoustics, more particularly to utilization of walls and other barriers to isolate acoustic transmission in one space or to reduce or minimize acoustic transmission from one space to another.

Conventional walls are flat structures that reflect some acoustic energy and transmit some acoustic energy. Typical walls used today are straight and flat. The materials of the walls currently used are typically drywall, which is a gypsum-type board. In general, the more stiff (less flexible) and the more massive a wall, the greater the acoustic attenuation.

In a typical present-day environment of an office or home, a wall is constructed using wood studs and ½-in drywall attached to the studs with nails or screws. One piece of drywall is placed on each side of the room. The drywall has two layers and provides attenuation whereby sound waves travel from one room through the first layer of drywall, and then the second layer of drywall, and then into the adjoining room. To increase the acoustic attenuation, ¾-in drywall may be used in lieu of ½-in drywall. In a typical present-day industrial environment, metal walls that are straight, flat, and thin are implemented along with sound-absorbing foam/fiberglass/mineral wool. A rubber barrier lined with foam may also be used. Various wall constructions for home, office, and industrial use are commercially available and in current use.

Two important terms that describe sound reduction of walls are "Transmission Loss" ("TL") and "Sound Transmission Class" ("STC"). These are among several terms conventionally used to describe the level of attenuation that occurs across a wall. Transmission loss is the reduction in acoustic power from one side of a wall to the other, and is expressed in dB. The higher the TL number, the greater the reduction in sound transmission. Transmission loss is frequency-dependent, and as such it is commonly plotted versus frequency. An alternative designation for describing sound reduction is sound transmission class, a single number that can conveniently represent how well a particular wall performs as compared with another wall.

Various factors limit the effectiveness of the conventional flat-plate wall design. Generally speaking, transmission loss is worst (lowest) at the fundamental resonant frequency of the plate. An additional factor is performance versus weight. In order to gain an increase in performance of a conventional flat-plate design, one must increase thickness and/or change the material.

SUMMARY OF THE INVENTION

In view of the foregoing, it is an object of the present invention to provide a better methodology for attenuating acoustic transmission across barriers such as walls separating rooms.

In accordance with exemplary practice of the present invention, an acoustic barrier includes two flat rectangular structures meeting along a vertical demarcation to describe therebetween a right or obtuse angle, i.e., an angle greater than or equal to ninety degrees and less than one hundred eighty degrees. Each flat rectangular structure is made of a material characterized by a sound transmission loss. The set angle between, and the respective materials of, the two flat rectangular structures are selected to reduce sound transmission by inducing respective acoustic vibratory motions of the two flat rectangular structures that tend to counteract each other. The inventive acoustic barrier also includes a housing for the two flat rectangular structures. Fabrication of an inventive acoustic assembly can involve either a bending of a single flat plate to achieve a desired angularity, or a joining of two separate flat plates to achieve a desired angularity. The two flat rectangular structures remain at the set angle.

Exemplary embodiments of the present invention serve to block transmitted noise from a room to an adjoining room. Inventive practice features, inter alia, a wall panel having a unique V-shape. As compared to a conventional wall panel having a flat plate design, an inventive wall panel increases sound transmission loss performance and does so with a high transmission-loss-to-weight ratio. Examples of inventive application include implementation as a wall that reduces transmission from one room to the next, or implementation as a set of walls forming an enclosure that completely surrounds a noisy object. As elaborated upon hereinbelow, inventive practice affords superior performance to existing designs.

The term "wall panel" is used herein to broadly refer to any structure serving as either a main wall structure or an auxiliary wall structure. A main wall structure serves as the main component of a wall, or as the wall itself. An auxiliary wall structure serves as an auxiliary component associated with an existing wall, such as adjoining or covering the wall. Conventional wall panels are rectangular and flat (planar). Exemplary embodiments of inventive wall panels are rectangular and V-shaped.

BRIEF DESCRIPTION OF THE DRAWINGS

The present invention will now be described, by way of example, with reference to the accompanying drawings, wherein like numbers indicate same or similar parts or components, and wherein:

FIG. 1 is an example of a basic sound transmission diagram.

FIG. 2 is table listing examples of known materials and their relative performance with respect to sound transmission.

FIG. 7 shows two vertical flat plates adjoining along respective vertical edges to form a right or obtuse horizontal angle Ø, also referred to herein as a "V-angle."

FIG. 10 shows two vertical flat plates adjoining along respective vertical edges to form a right or obtuse horizontal angle Ø.

DESCRIPTION OF EXEMPLARY EMBODIMENTS OF THE INVENTION

Figure 3:
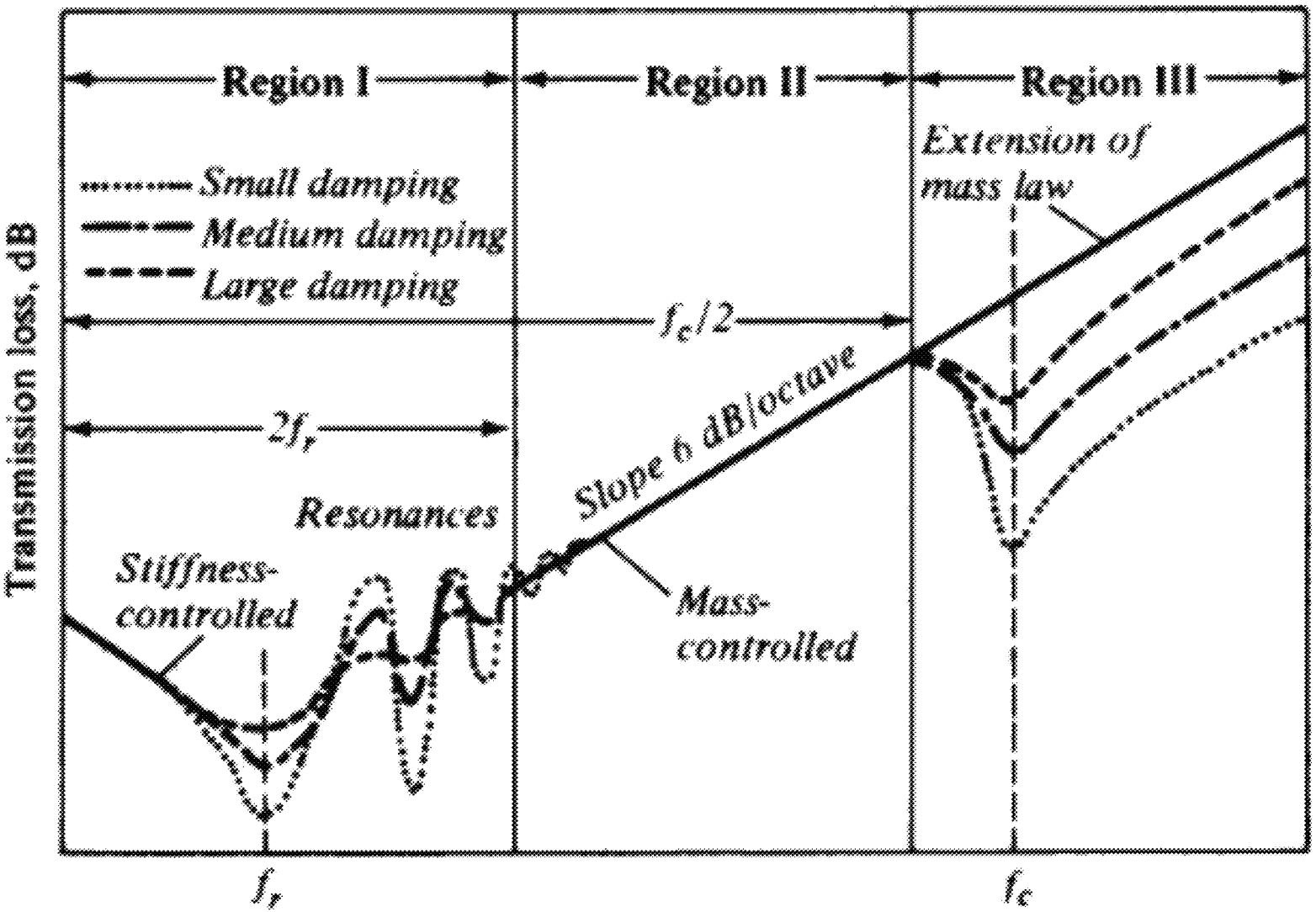
FIG. 3 is a graphical representation exemplifying the performance due to stiffness and mass of a simply supported plate. The higher the transmission loss (i.e., the elevation of the line), the better the performance. This graph is taken from J. S. Lamancusa's Noise Control Class at Pennsylvania State University, about 1 Dec. 2000.

Reference is now made to FIG. 1, which illustrates reduction of airborne acoustic energy by a conventional barrier. Two adjoining rooms, viz., room 31*a* and room 31*b*, are separated therebetween by a conventional acoustic wall panel (acoustic barrier) 50. Wall panel 50 can include a single flat plate 51 or two parallel adjoining flat plates 52. FIG. 1 shows a source (incident) noise arrow S, a reflected noise arrow R, and a transmitted noise arrow T. It is desirable that room 31*b* be unaffected by the sound level produced by room 31*a*.

As shown in FIG. 1, the acoustic energy that originates in room 31*a* and impinges upon wall 50 is represented by source (incident) noise arrow S. A first portion of the acoustic energy originating in room 31 is reflected off wall 50, as represented by reflected noise arrow R. A second portion of the acoustic energy originating in room 31 is transmitted through wall 50, as represented by transmitted noise arrow T. In this example, conventional wall 50 is a planar structure that may be conceived to include, for instance, a single flat plate 51 or two parallel adjoining flat plates 52, directly attached to each other surface-to-surface in a layered configuration.

Figure 28:
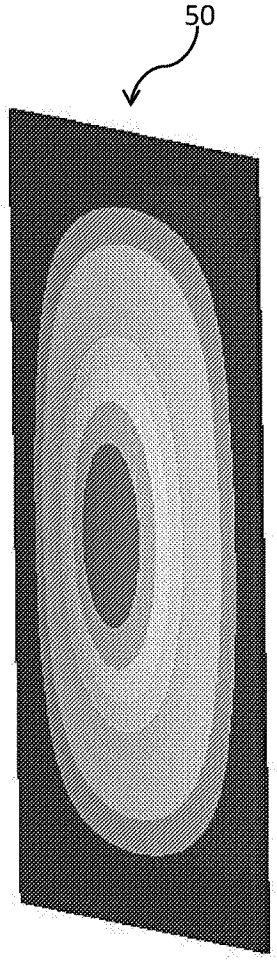
FIG. 28 is a diagrammatic perspective graphical representation of an example of a simply supported conventional flat-plate wall panel, illustrating fundamental natural frequency, $f_r$ (first mode or breathing mode) of the conventional flat-plate wall panel.
Figure 27:
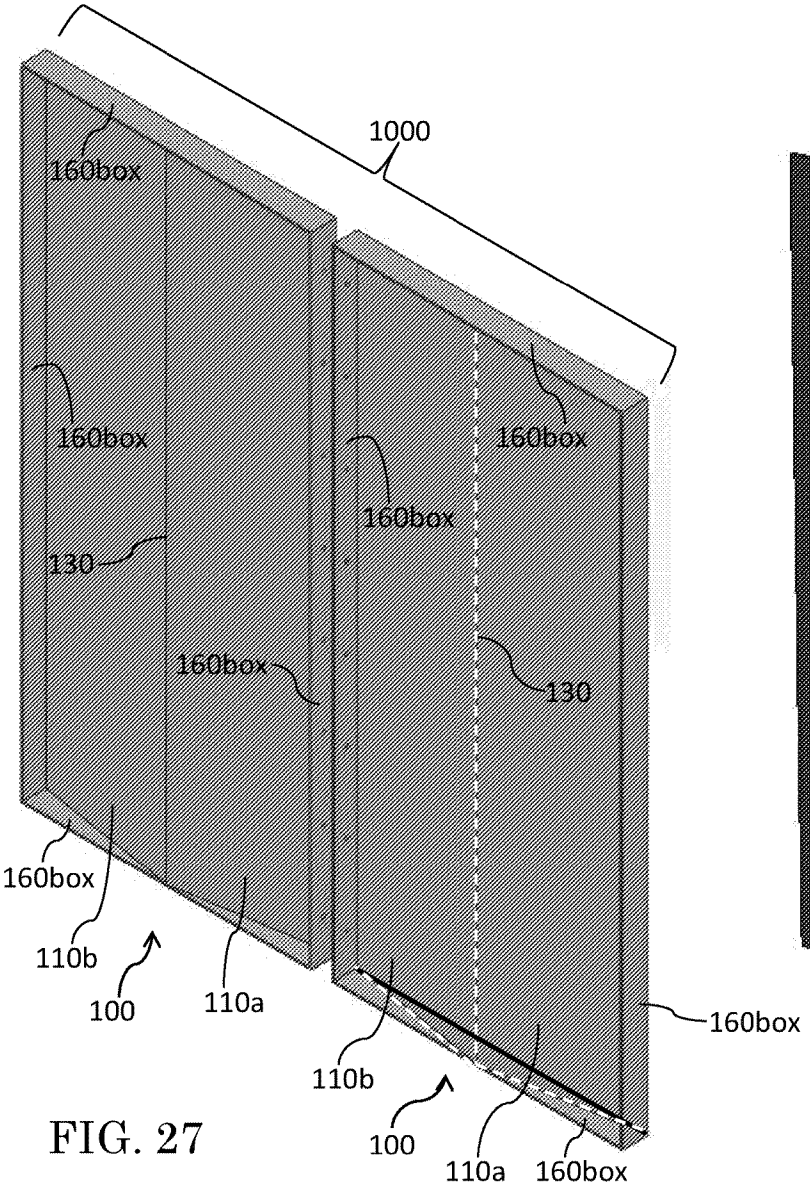
FIG. 27 is a perspective view of an example of two inventive V-shaped acoustically attenuative wall panels that are adjacently positioned for being joined to each other along their respective edges, thereby forming an inventive acoustically attenuative wall or portion thereof.

The worst single transmission loss value across all frequencies occurs at the fundamental resonant frequency of the plate. This frequency is identified as point $f_r$ in FIG. 3. The mode shape of this example of a conventional flat-plate wall panel at this frequency is depicted in FIG. 28, which shows a large portion of the flat plate moving in unison. Generally speaking, the limitation of a flat plate design is that its first mode shape is a breathing mode, which makes the flat plate an effective radiator of sound. This is detrimental to transmission loss, such as indicated by frequency $f_r$ in FIG. 3. In general, the first mode shape will provide the worst transmission loss of the flat plate.

Performance-to-weight ratio is another limitation for the standard flat plate design. For instance, the area of performance shown in "Region I" of FIG. 3 is the stiffness-controlled region for a flat plate. In this region, the higher the stiffness, the higher the transmission loss will be.

Various terminology is conventionally used to describe sound reduction of walls. Transmission loss of a wall is plotted versus frequency as shown in FIG. 3. An alternative method of describing sound reduction is a numerical designation called Sound Transmission Class (STC). Since STC is a single number, it represents a quick an easy way to rank how well a particular wall performs in comparison to another wall.

Some materials commonly used for acoustical applications are shown in FIG. 2. The tabular information of FIG. 2 is taken from page 91 of "Acoustical Products and Systems for Noise Control," catalogue, Industrial Noise Control, Inc. (INC), 401 Airport Road, North Aurora, Ill., 60542 (2007), which may be found on the company's website. The higher the sound transmission class (STC), the higher the transmission loss transmission loss (TL).

An exemplary embodiment of an inventive acoustically stiff wall panel 100 essentially describes a V-shaped acoustic barrier that is supported at its edges. According to a first mode of inventive practice, the inventive V-shaped panel 100 is supported at its edges by flanges and lower and upper horizontal structural members. For instance, two angularly joined vertical plates are attached to a vertical frame, a bottom horizontal planar member, and a top horizontal planar member. The flanges attached along the V-shape's edges can be used for connection to other structures. According to a second mode of inventive practice, the inventive V-shaped panel 100 is supported at its edges by a box-shaped hollow enclosure.

Referring now to FIG. 5 through FIG. 36, inventive acoustic wall panel 100 includes two congruent rectangular flat plates 110, viz., a first rectangular flat plate 110*a* and a second rectangular flat plate 110*b*. Each rectangular flat plate has four edges 120, namely: a top horizontal plate edge 120top; a bottom horizontal plate edge 120bot; a first vertical plate edge 120*vp*; and a second vertical plate edge 120*vq*.

Figure 7:
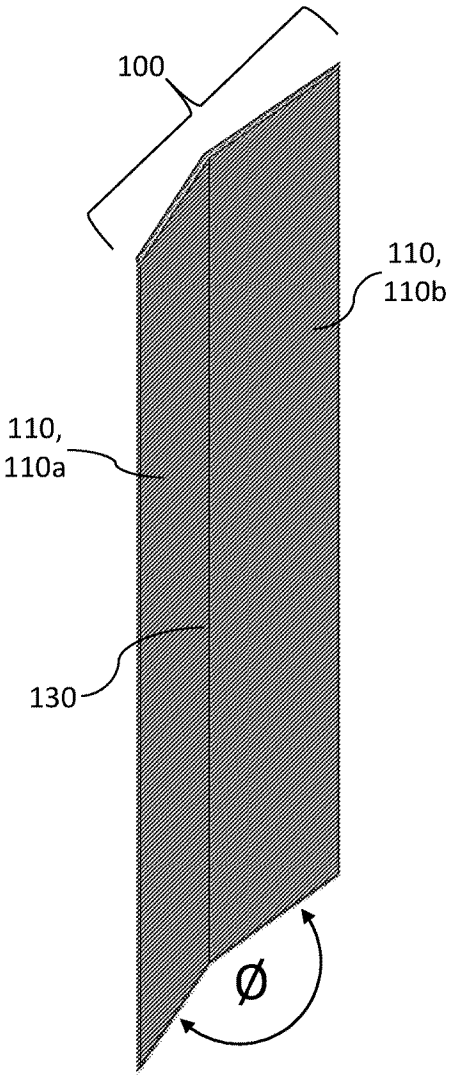
FIG. 7 is a front perspective view of an exemplary embodiment, in accordance with the present invention, of a V-shaped acoustically attenuative wall panel in a basic form.
Figures 8, 9, 10:
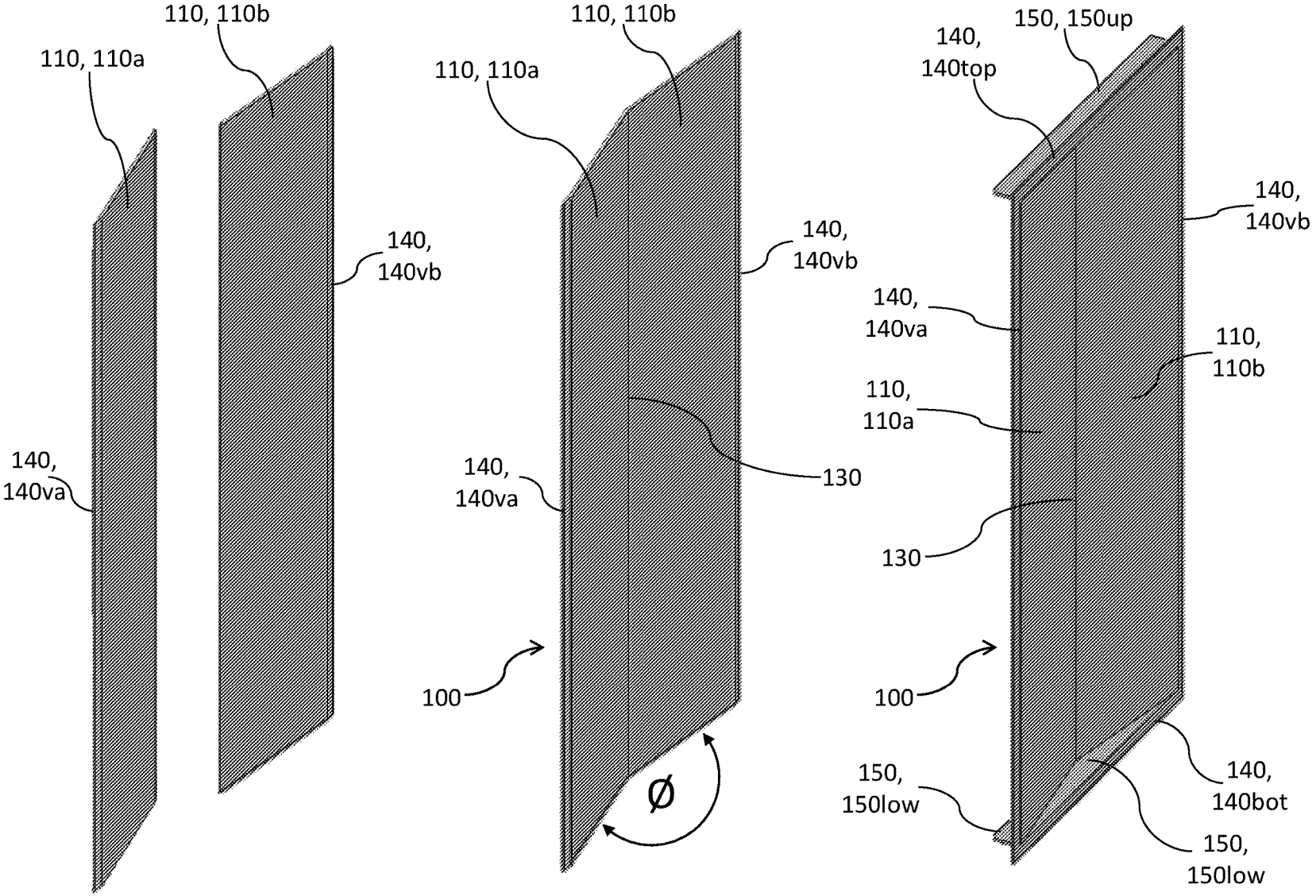
FIG. 8 is a perspective view, similar to the view of FIG. 6, of an example of a pair of vertical rectangular flat plates that may be joined in accordance with the present invention. As distinguished from FIG. 6, each of the two vertical flat plates shown in FIG. 8 has a flange attached along a vertical edge of the plate.
FIG. 9 is a front perspective view, similar to the view of FIG. 7, of an exemplary inventive embodiment of a V-shaped acoustically attenuative wall panel wherein each panel has a vertical flange attached along a vertical edge of a vertical rectangular plate such as shown in FIG. 8.
FIG. 10 is the view of FIG. 9 additionally showing two horizontal flanges and two horizontal planar members. In each plate, an upper horizontal flange is attached along the upper edge of the plate, a lower horizontal flange is attached along the lower edge of the plate, an upper horizontal planar member is attached to the upper horizontal flange, and a lower horizontal planar member is attached to the lower horizontal flange. Similarly as shown in FIG. 7 and FIG. 9.
Figure 12:
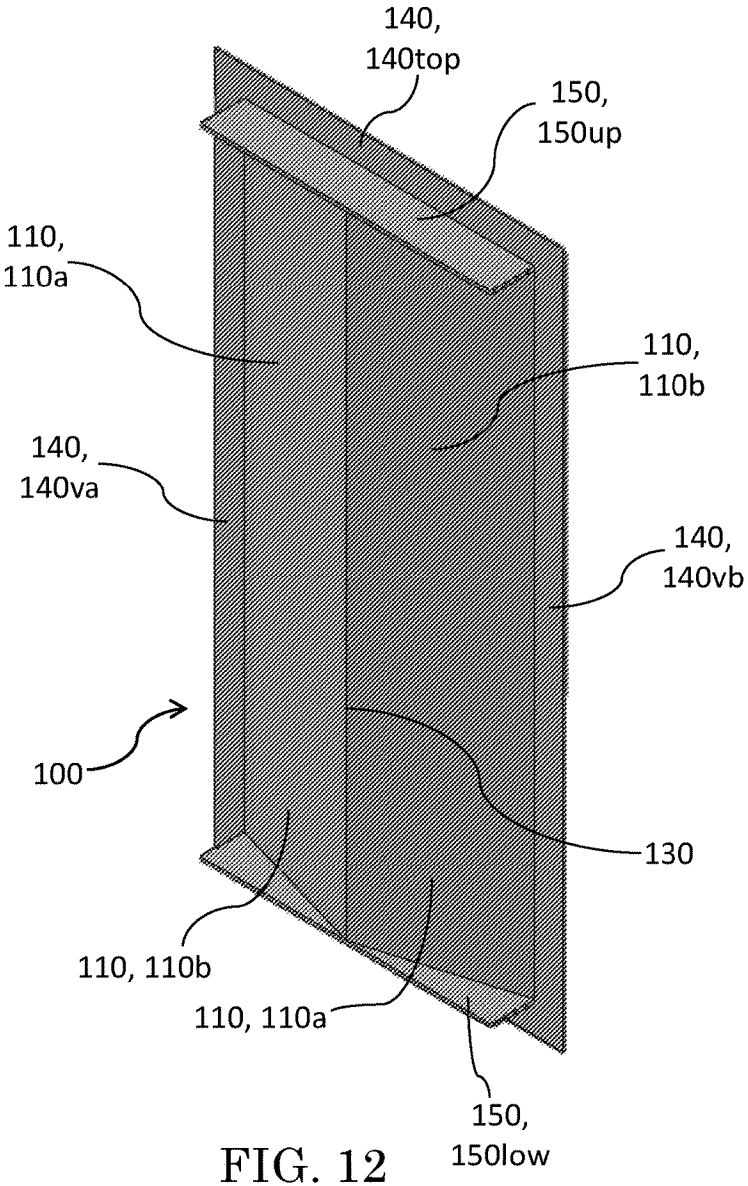
FIG. 12 is a back perspective view of the inventive embodiment shown in FIG. 11.
Figure 11:
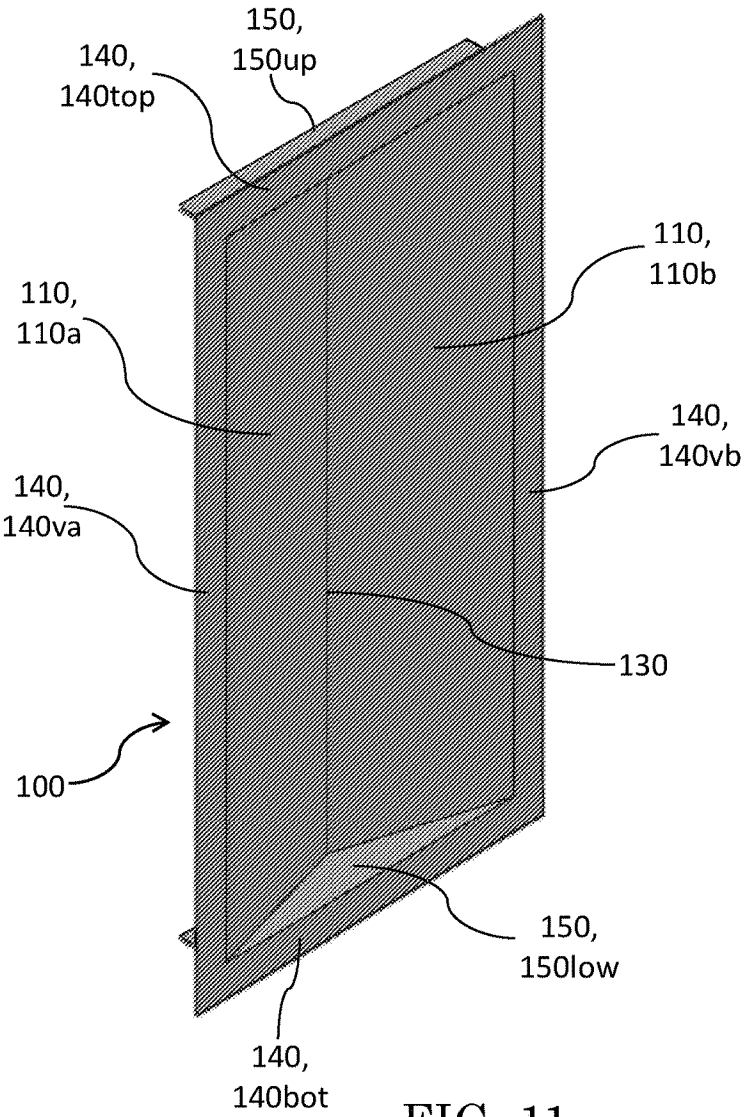
FIG. 11 is a front perspective view, similar to the view shown in FIG. 10, of another exemplary inventive embodiment of a V-shaped acoustically attenuative wall panel. The inventive embodiment shown in FIG. 11 is characterized by a smaller V-angle Ø than that characterizing the inventive embodiment shown in FIG. 10.
Figure 14:
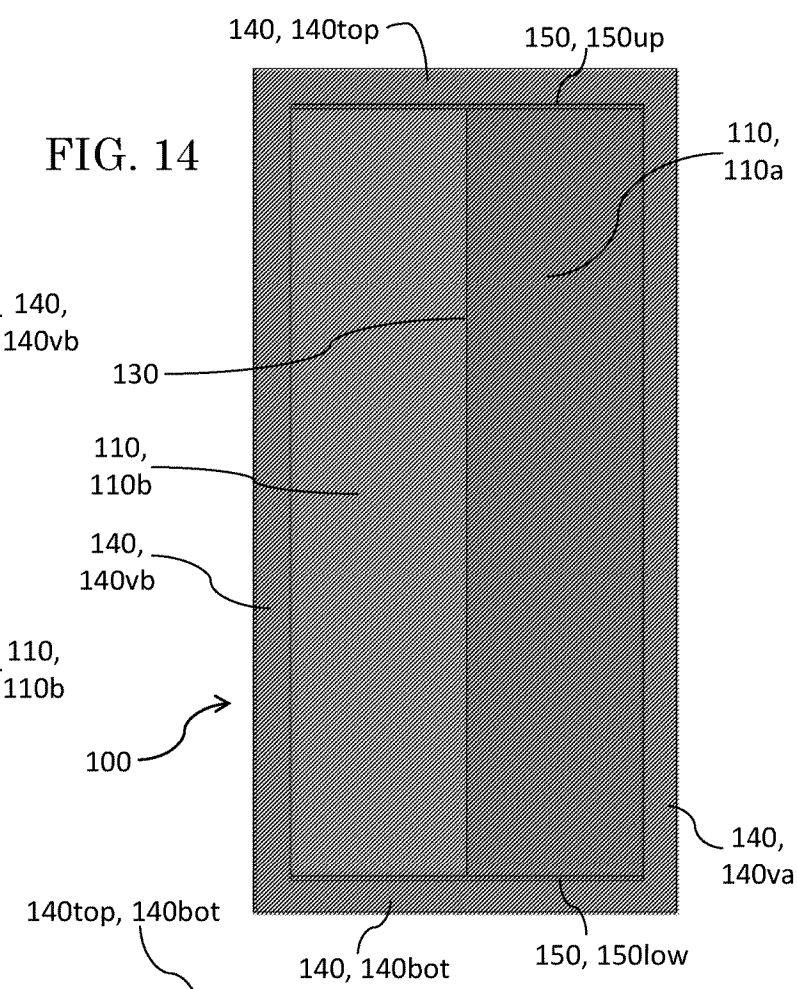
FIG. 14 is a back elevation view of the inventive embodiment shown in FIG. 11.

A vertical plate-to-plate junction 130 is formed along respective vertical edges 120 of the two V-joined plates 110. Angle Ø, indicated in FIGS. 7 and 9, is less than 180° and is formed by the two wall plates 110*a* and 110*b*. According to exemplary inventive practice, wall plates 110 are each made of a material that reduces acoustic transmission, such as those listed in FIG. 2. V-joined plates 110 may be made of the same or different materials, and may be joined, for example, by mechanical (e.g., bolted together) and/or adhesive means. The ordinarily skilled artisan who reads the instant disclosure will appreciate the various methods and techniques that may be practiced for joining plates 110*a* and 110*b* to each other along vertical junction 130.

Figure 6:
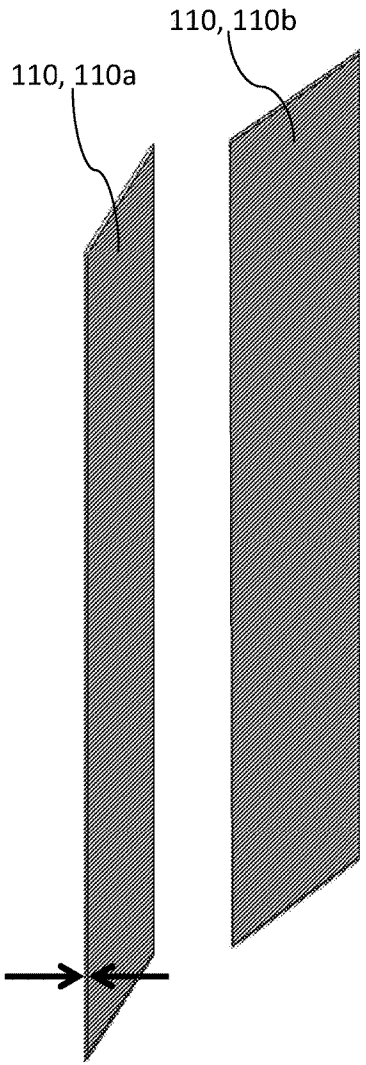
FIG. 5 and FIG. 6 are elevation and perspective views, respectively, of an example of a pair of vertical rectangular flat plates that may be joined in accordance with the present invention.
Figure 5:
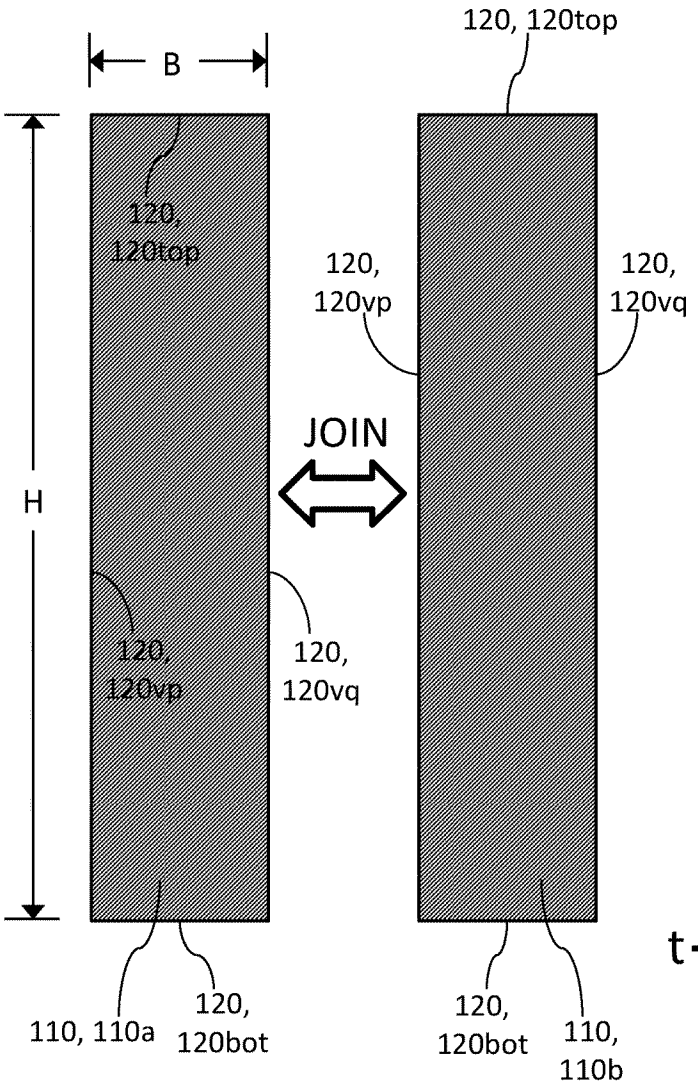
Figure 37:
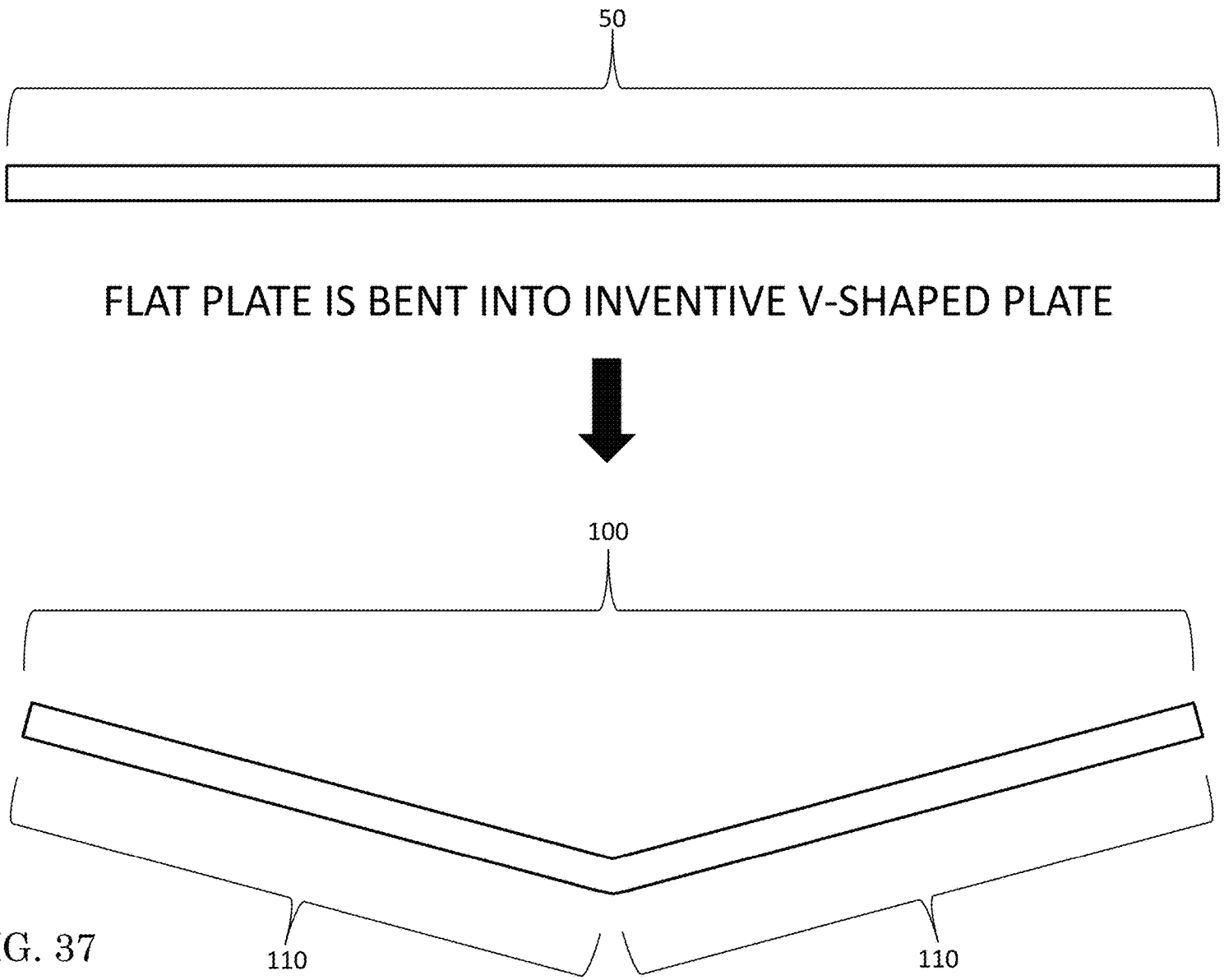
FIG. 37 is a diagram illustrating fabrication of an inventive V-shaped wall panel according to an inventive method that includes bending of an original flat plate to achieve an inventive V-shape.

FIGS. 5 through 7 illustrate a conjoining of two separate flat plates 110 along respective vertical edges 120 to form a vertical junction 130. With reference to FIG. 37, some inventive embodiments provide for a bending of a single flat plate 50 along a vertical linear demarcation to form a vertical junction 130 between two angled flat-plate sections 110 of the original flat plate 50. Regardless of whether inventive fabrication includes bending of one flat plate 50, or coupling of two individual flat plates 110, the resultant pair of flat plates (or flat plate sections) 110 form an angle Ø therebetween in an integral V-shaped structure 100, which is exemplarily made of a metal such as steel or aluminum. A plate-bending process may involve several bends to form the desired angular V-shape of structure 100. Remaining pieces (e.g., flanges 140, flat member 150, and/or frame 160) can be welded or otherwise attached to the basic V-shape structure 100, however made, to produce an inventive acoustically attenuative assembly 100.

Inventive wall panel 100 is exemplarily embodied to also include a housing (e.g., frame) 160 for the V-joined panels 110*a* and 110*b*. The present invention's housing 160 can be embodied in various configurations, such as a planar frame 160pic (shown in FIGS. 10-12, 13-18, 32, and 34), or a box frame 160box (shown in FIG. 27). Planar frame 160pic is akin to a picture frame. Box frame 160box describes an open rectangular box shape or rectangular prism. Planar frame 160pic can be practiced, for instance, as rectangular planar combination of four connected straight flanges 140 (two horizontal flanges and two vertical flanges), or alternatively as a single integral picture frame-like member.

As shown in FIGS. 32 through 35, planar frame 160pic represents a rectangular planar combination of four connected straight flanges 140—i.e., a combination of four straight flanges 140 connected at the top, bottom, and two sides, respectively, of the two joined V-shaped plates 110. Flanges 140 are a top horizontal flange 140top, a bottom horizontal flange 140bot, a first vertical flange 140*va*, and a second vertical flange 140*vb*. Two support members 150, viz. upper support member 150up and lower (base) support member 150low, are attached to top horizontal flange 140top and bottom horizontal flange 140bot, respectively, and lend structural support to the two V-shaped joined plates 110.

According to exemplary inventive practice, the two support members 150up and 150dowm are rectangular and congruent. Horizontal upper support member 150up lies in a horizontal geometric plane and is perpendicularly attached to top horizontal flange 140top, which lies in a vertical geometric plane. Horizontal upper support member 150up is also perpendicularly attached to the V-paired plates 110 along the respective edges 120top of plates 110, each of which lies in a vertical geometric plane. Similarly, horizontal lower support member 150low lies in a horizontal geometric plane and is perpendicularly attached to bottom horizontal flange 140bot, which lies in a vertical geometric plane. Horizontal lower support member 150low is also perpendicularly attached to the V-paired plates 110 along the respective edges 120bot of plates 110, each of which lies in a vertical geometric plane.

Figure 16:
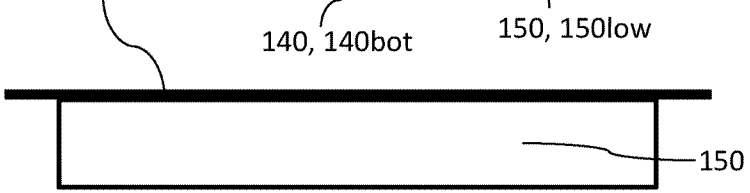
FIG. 16 is a diagrammatic plan view illustrating the relationship, in the inventive embodiment shown in FIG. 11, between a horizontal flange and its associated horizontal planar member.
Figure 13:
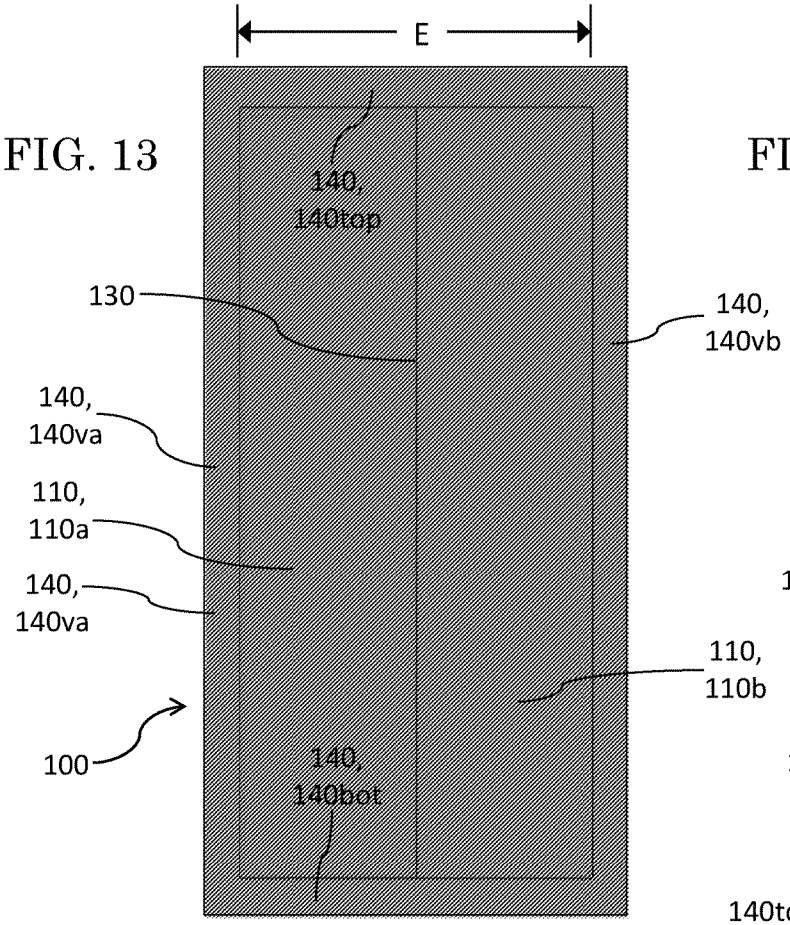
FIG. 13 is a front elevation view of the inventive embodiment shown in FIG. 11.
Figure 15:
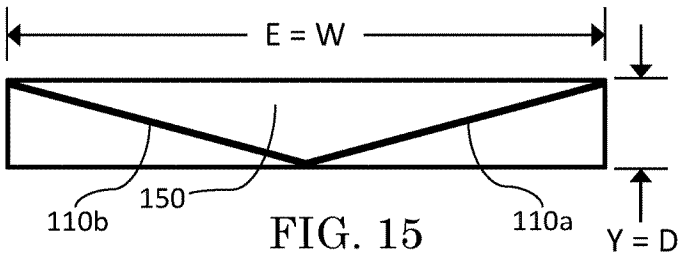
FIG. 15 is a diagrammatic plan view illustrating the relationship, in the inventive embodiment shown in FIG. 11, between the two coupled V-angled plates and either the upper or lower horizontal planar member.
Figure 18:
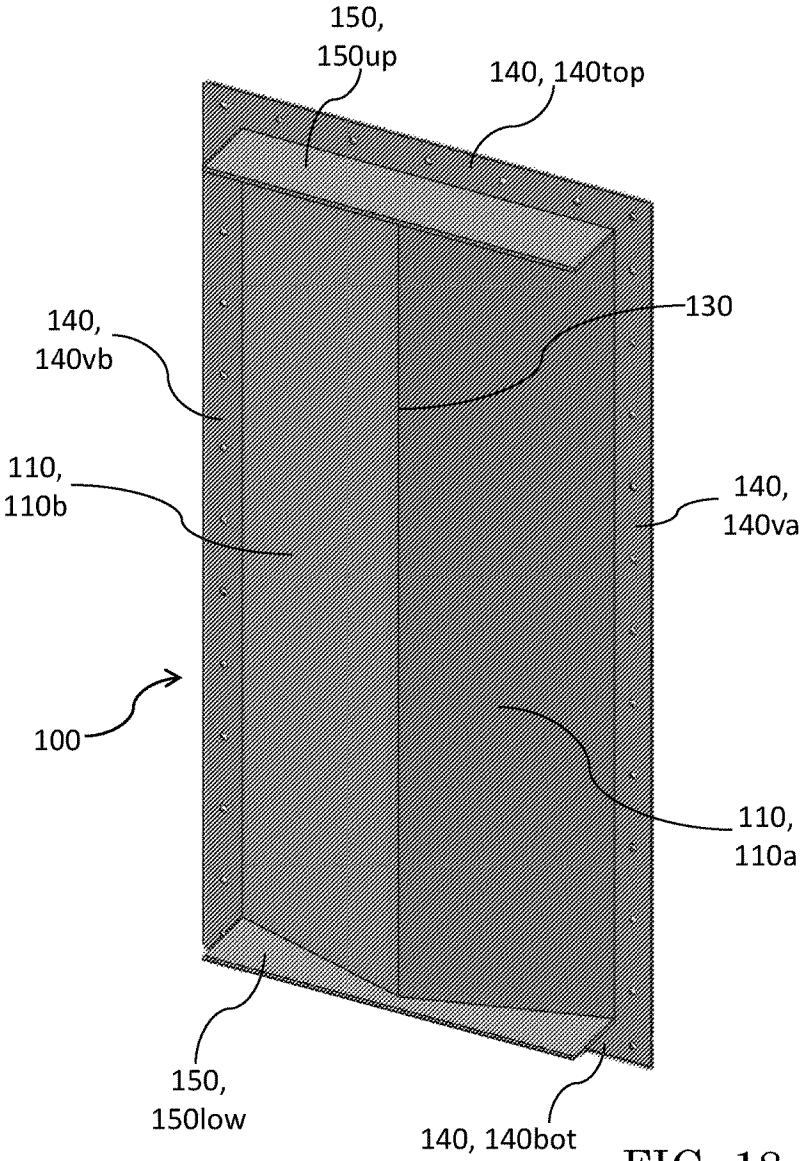
FIG. 17 and FIG. 18, respectively, are front and back perspective views (similar to the views of FIG. 11 and FIG. 12) of another exemplary inventive embodiment of a V-shaped acoustically attenuative wall panel.
Figure 17:
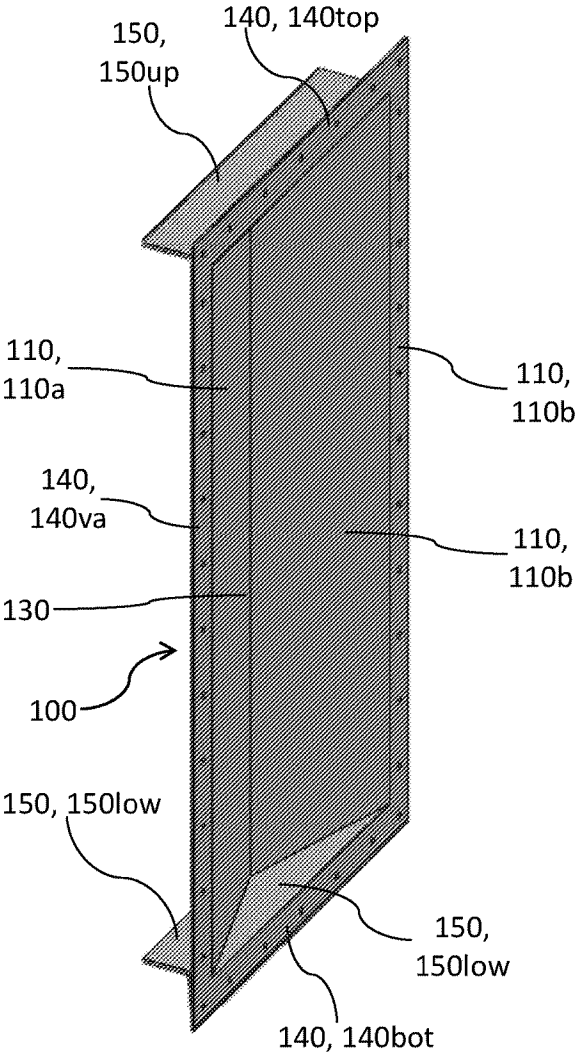
Figure 19:
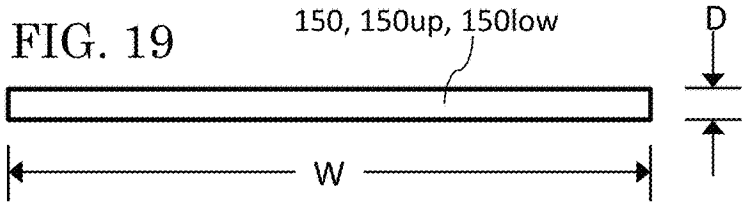
FIG. 19 through FIG. 22 are plan views of various examples of horizontal planar members of various sizes that may be used in inventive practice. These examples of horizontal planar members have the same length but different widths.
Figure 23:
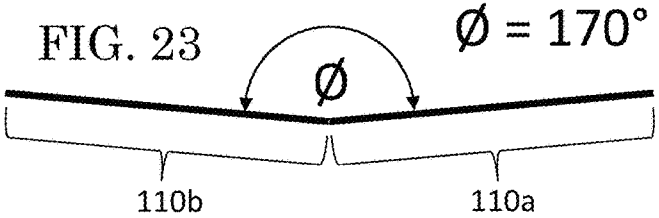
FIG. 23 through FIG. 26 are plan views of various examples of an inventive V-shaped acoustically attenuative wall panel. These examples of inventive V-shaped panels have different V-angles.
Figure 20:
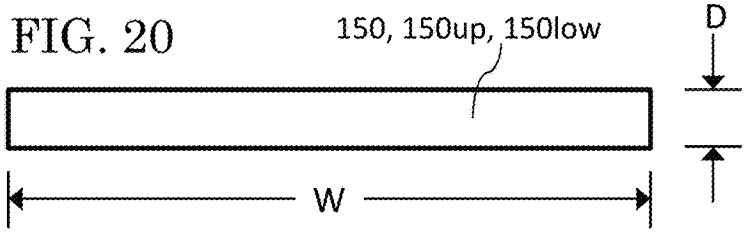
Figure 24:
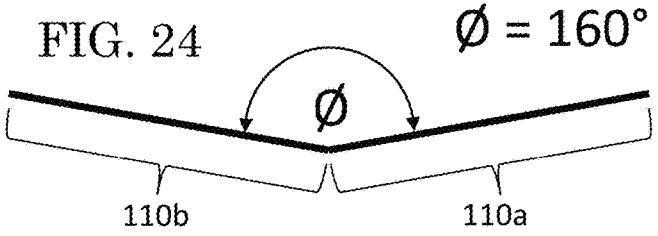
Figure 21:
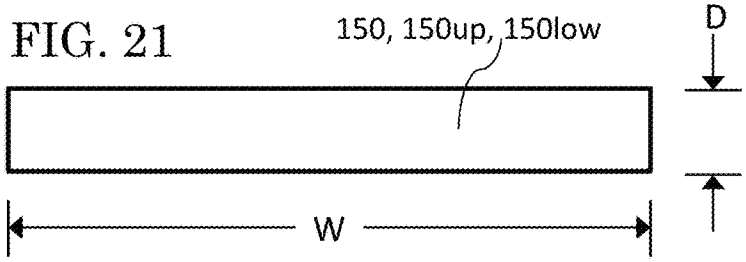
Figure 25:
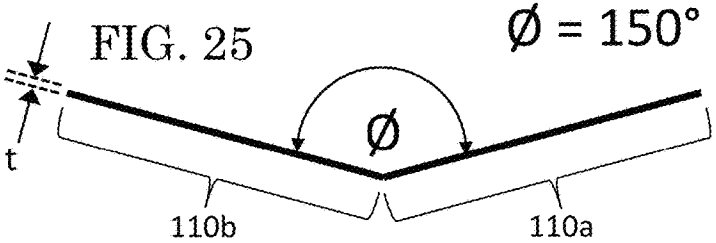
Figure 22:
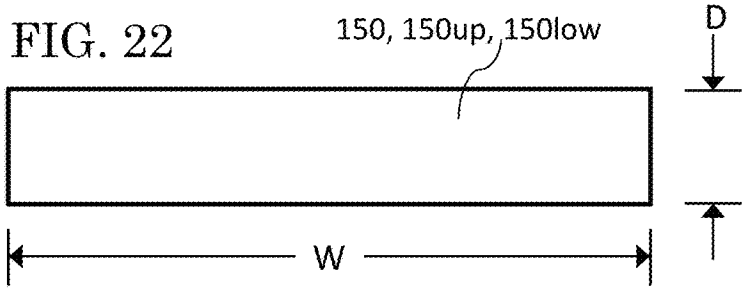
Figure 26:
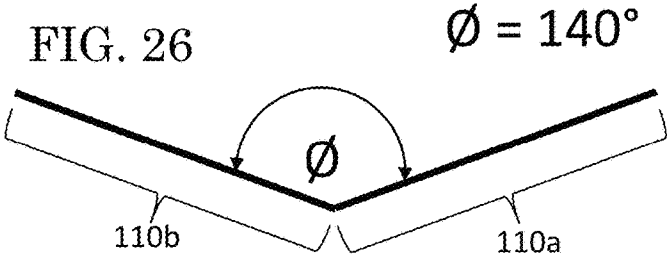

With reference to FIGS. 15 and 16, in each acoustically attenuative wall panel 100, lower support member 150low and upper support member 150up are vertically aligned. Lower support member 150low is characterized by a member width W. Upper support member 150up is characterized by the same member width W. The two V-joined plates 100 are characterized by a horizontal expanse E that equals, in linear distance measurement, each support member width W. Further, the two V-joined plates 100 are characterized by a horizontal front-to-back traverse Y that extends perpendicularly from vertical plate-to-plate junction 130 to geometric back line M, which is tangent to the two back vertical plate edges 120. Traverse distance Y equals each support member depth D. The two V-joined plates 100 are attached to lower support member 150low within the extents of its width W and its depth D, and to upper support member 150up within the extents of its width W and its depth D. That is, V-joined plates 100 are congruous with and do not overlap either support member 150 in any direction.

It may sometimes be preferable inventive practice to effect attachment of the vertical flanges to plates 110 prior to effecting attachment of the horizontal flanges. That is, vertical flanges 140*va* and 140*vb* are attached to first plate 110*a* and second plate 110*b*, respectively, along respective vertical edges 120*vp* and 120*vq*. Subsequently, horizontal flanges 140top and 140bot are attached to vertical flanges 140*va* and 140*vb*, respectively, and to upper support member 150up and lower support member 150low, respectively. Flange apertures 170, such as shown in FIGS. 32 through 35, serve to facilitate attachment of flanges 140 to each other or to support members 150, or attachment of adjacent inventive wall panels 100 to form an inventive acoustic wall 1000.

With reference to FIGS. 5 through 7 and FIGS. 19 through 26, the plates 110 and the structural support members 150 are each rectangular and are characterized by rectangular dimensions. Each plate 110 has a plate breadth (width) b, a plate height h, and a plate thickness t. Each support member 150 has a support member width (breadth) w and a support member depth d. Furthermore, in a given inventive wall panel 100, the two plates 110*a* and 110*b* are disposed at an angle Ø with respect to each other that is in the range between at least ninety degrees and less than 180 degrees. That is, $90° \leq Ø < 180°$. According to frequent inventive practice $120° \leq Ø \leq 150°$.

Figure 36:
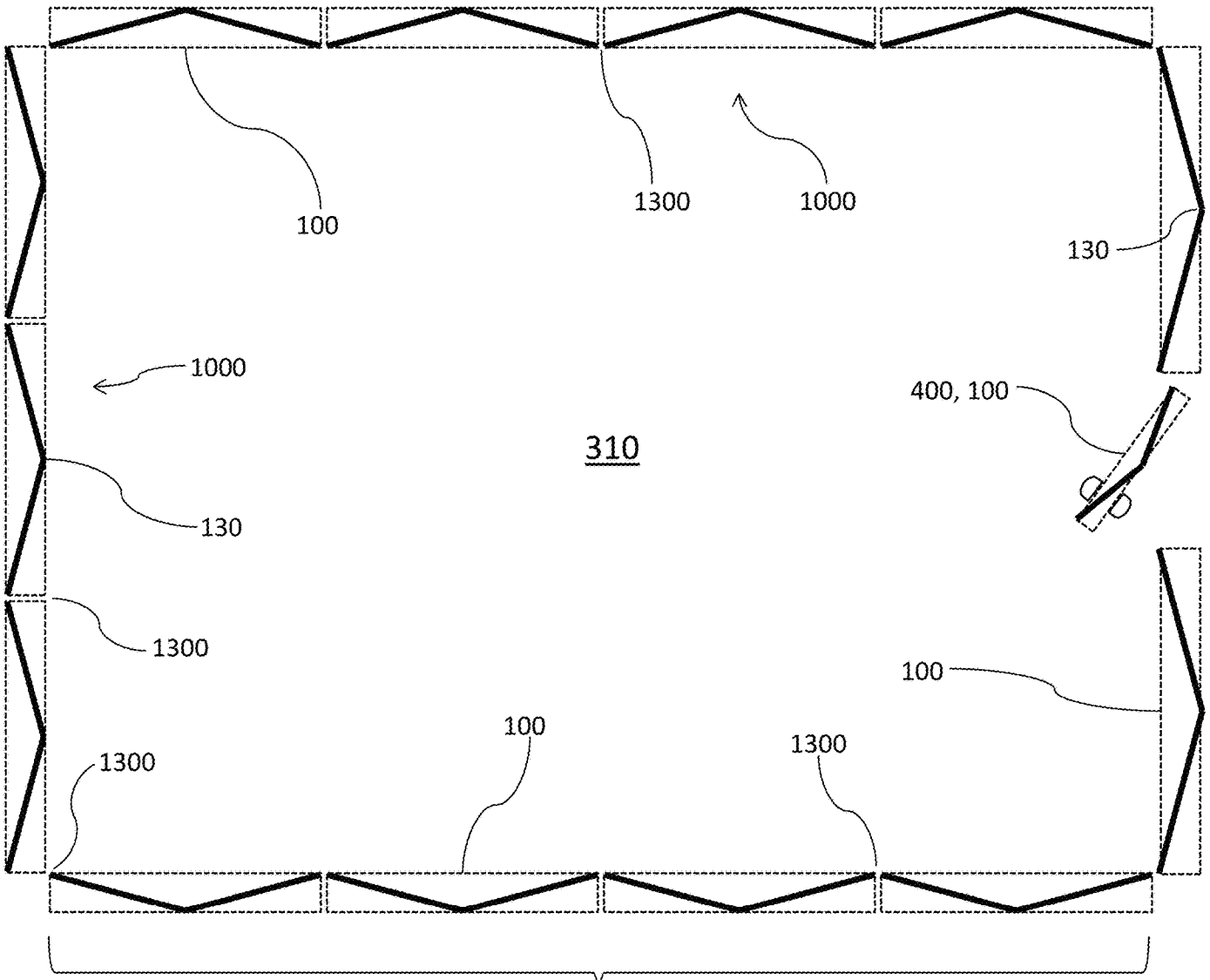
FIG. 36 is a top plan view of an example of an inventive acoustically attenuative wall that includes several connected inventive V-shaped wall panels and that is configured to enclose a space (e.g., a room).

Reference now being made to FIG. 36, room 310 (including walling enclosure, ceiling, and floor) is shown to be delimited by fourteen inventive acoustic wall panels 100. The inventive wall panels can vary in size, materials, and orientation of the double-plate V-joined panel in terms of whether vertical plate-to-plate junction 130 (otherwise expressed, the vertex of the V-shape) is nearer the interior or the exterior of room 310. That is, the V-shape can be open inward or open outward vis-à-vis the area inside room 310. A room is not necessarily rectangular and can describe practically any polygonal shape. As shown in FIG. 36, one of the inventive panels 100 circumscribing room 310 can be an inventive panel door 400.

An exemplary inventive acoustic wall 1000 includes two or more inventive acoustic panels 100 that, depending on the inventive embodiment, can be arranged in a variety of ways. For instance, the entire set of fourteen inventive acoustic panels 100 shown in FIG. 36 constitutes an inventive acoustic wall enclosure 1000. As another example, a linear section of inventive acoustic wall enclosure 1000, including for instance three or four inventive panels 100, can be designated as constituting an inventive acoustic side wall 1000. A pair of adjacent inventive wall panels 100 may be attached along a vertical panel-to-panel junction 1300, which may be formed by associating respective vertical flanges 140*va* and 140*vb* of the two adjacent panels 100.

In describing an important acoustic principle of the present invention, let us assume that a sound source is situated on one side of an inventive V-shaped wall panel 100. As sound from that source strikes inventive wall panel 100, the sound excites the two plates 110 of inventive wall panel 100, causing them to vibrate. The resulting respective motions of wall plates 110*a* and 110*b* are each in the form of bending waves. "Bending wave" motion is motion perpendicular to the plane of a wall plate 110. The respective motions of the two plates 110 dictate the overall transmission loss performance of the inventive wall panel 100. More specifically, the less a panel 110 moves from an amplitude perspective, or the less area of the panel 100 is in motion, the better the transmission loss performance of the panel 110.

Figure 29:
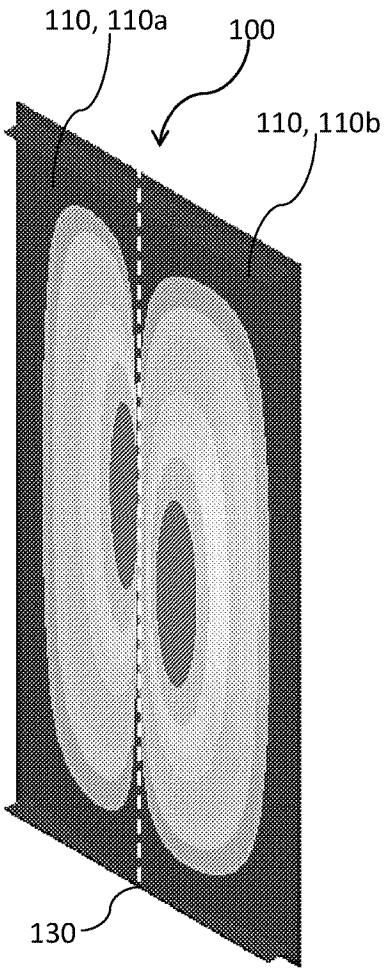
FIG. 29 is a diagrammatic perspective graphical representation, similar to the representation of the conventional flat-plate wall panel shown in FIG. 28, of an example of an inventive V-shaped double-plate wall panel, illustrating the fundamental natural frequency $f_r$ (first mode or breathing mode) of the inventive V-shaped double-plate wall panel. Note that drawings herein such as FIG. 12 depict an inventive V-shaped double-plate wall panel that is un-deformed. The respective motions of the two attached plates shown in FIG. 29 are in opposite directions.

As shown in FIG. 28, the worst performance of a flat simply supported plate comes at it fundamental mode. FIG. 28 shows the mode shape of this mode (fundamental natural frequency $f_r$, or "breathing mode") for a simply supported flat plate. An exemplary inventive wall panel 100 does not have this fundamental mode. In contrast, the present invention's first mode is shown in FIG. 29. The mode shown in FIG. 29 has two vibrating wall plates 110 that produce sound out of phase and that provides cancellation of airborne sound.

Among its benefits, an inventive V-shaped wall 100 offers a great deal of stiffness that resists the bending of the two wall plates 100. Particularly significant is the vertical plate-to-plate junction 130 of inventive V-shaped wall 100, i.e., in two-dimensional geometric profile view, the vertex of the V-shape. As illustrated in FIG. 29, vertical plate-to-plate junction 130 causes the overall motion of inventive V-shaped wall 100, when in first acoustic mode, to be constituted by respective motions of plates 100*a* and 100*b* that are in opposite directions.

The present invention, as exemplarily embodied, blocks transmitted noise from a room to an adjoining room. The present invention's unique V-shape increases the transmission loss performance. An inventive wall panel 100 increases TL performance with a high transmission loss-to-weight performance ratio as compared to a flat plate design. A finite element model of the various designs of flat plates 110 and inventive V-shaped wall panel 100 have been developed and analyzed by the present inventors. This computer model demonstrates the benefits of the present invention's V-shaped wall panel design in performance and in performance-to-weight ratio. Model results are shown in FIGS. 30 and 31.

Figure 30:
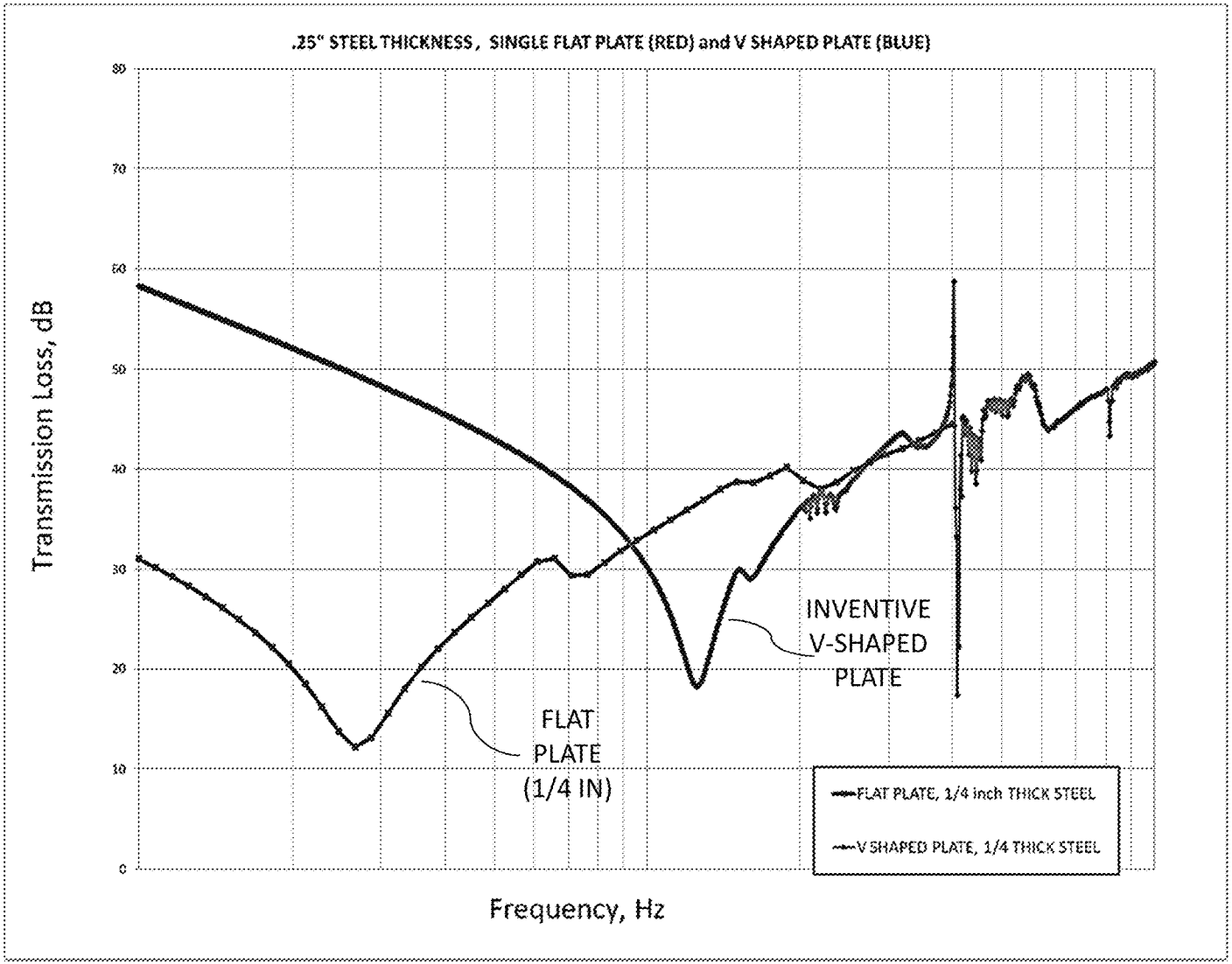
FIG. 30 is a graph illustrating respective performances, in terms of transmission loss, of an example of an inventive V-shaped wall panel versus an example of a conventional flat-plate wall panel.

FIG. 30 illustrates how an inventive V-shaped wall panel 100 outperforms a conventional flat wall structure. Note that in this graphical illustration the inventive design and the conventional design each use ¼ inch thick steel, and both designs have the same outer dimensions. At some frequencies on the left of the plot the transmission loss is increased by approximately 30 dB. The present invention increases transmission loss and increases performance-to-weight ratio, as compared to a flat wall plate 50.

Figure 31:
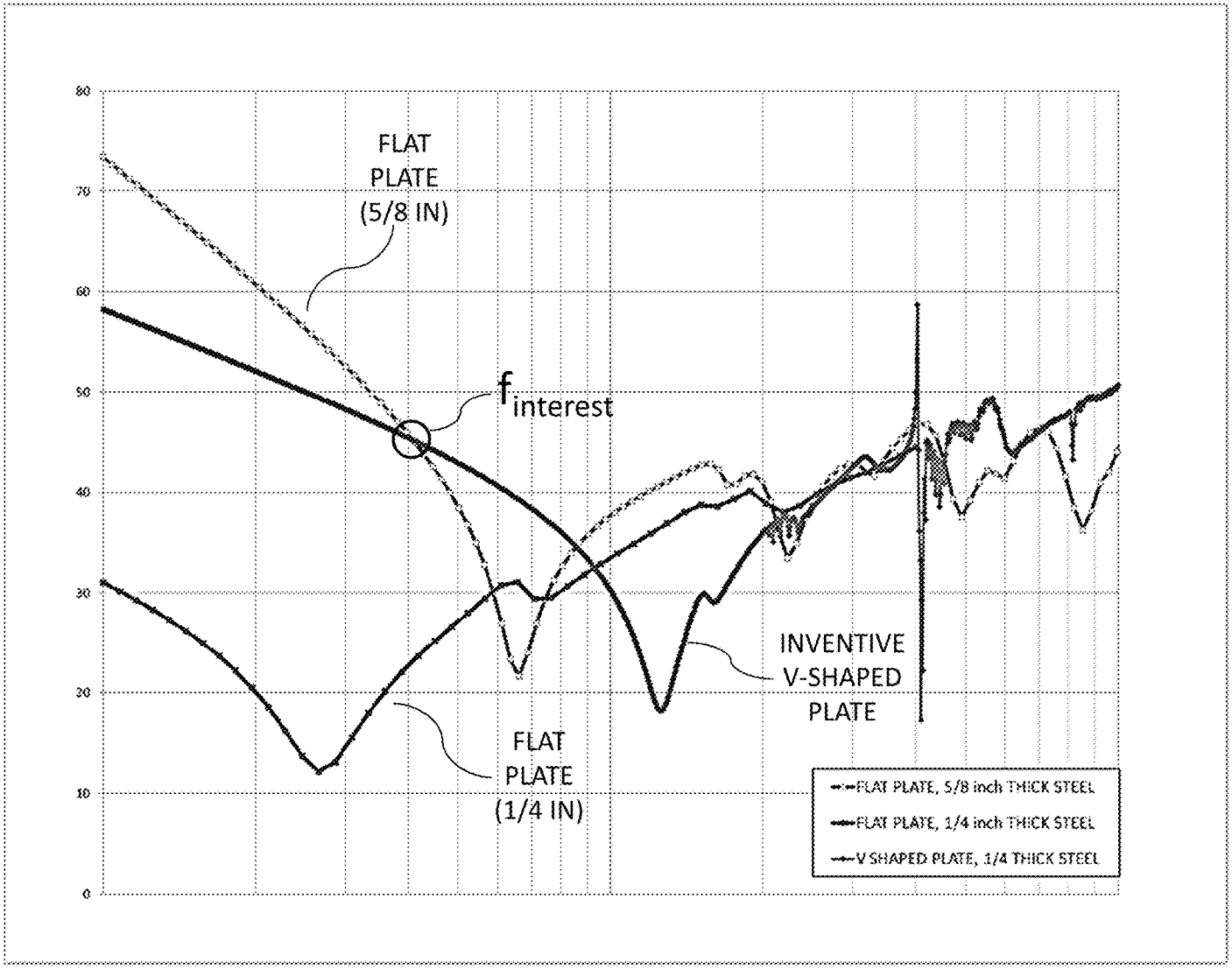
FIG. 31 is a graph (similar to the graph shown in FIG. 30) illustrating how the thickness of the conventional flat-plate wall panel shown in FIG. 30 would need to be increased 125% in order to obtain acoustical performance comparable to that of the inventive V-shaped wall panel shown in FIG. 30.
Figure 33:
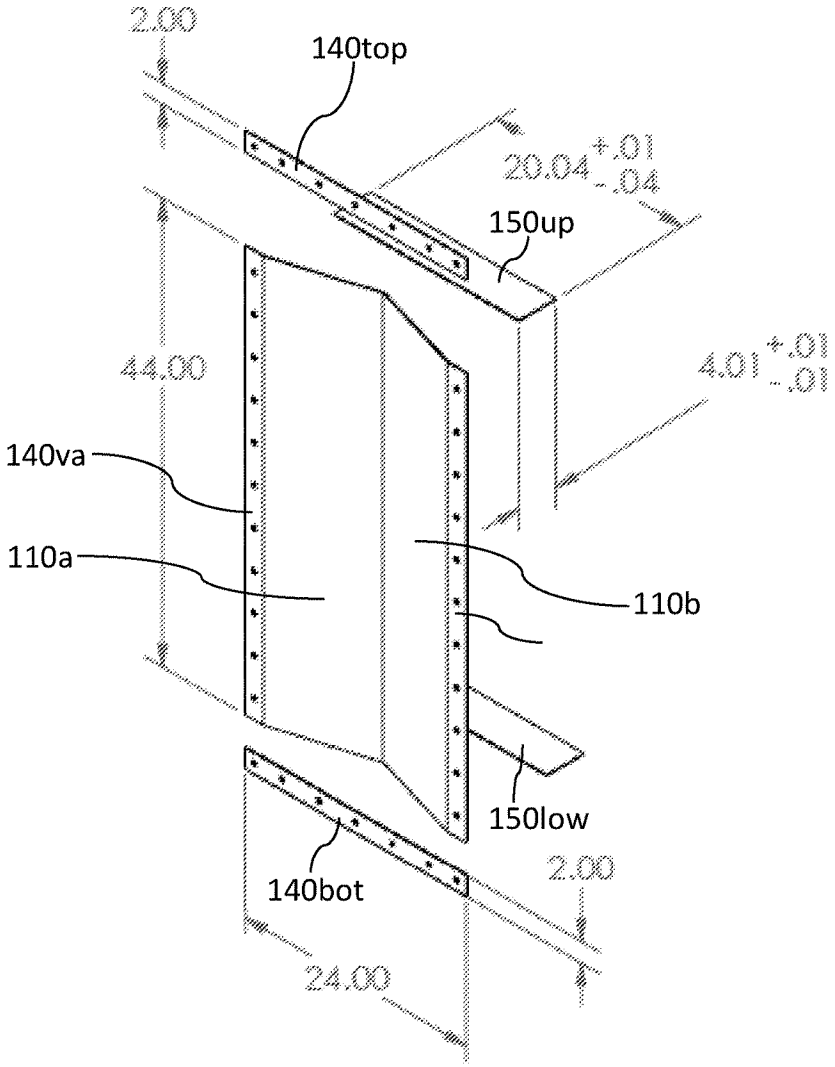
FIG. 32, FIG. 33, FIG. 34, and FIG. 35 are various perspective views illustrating fabrication of an an example of an inventive V-shaped wall panel.
Figure 32:
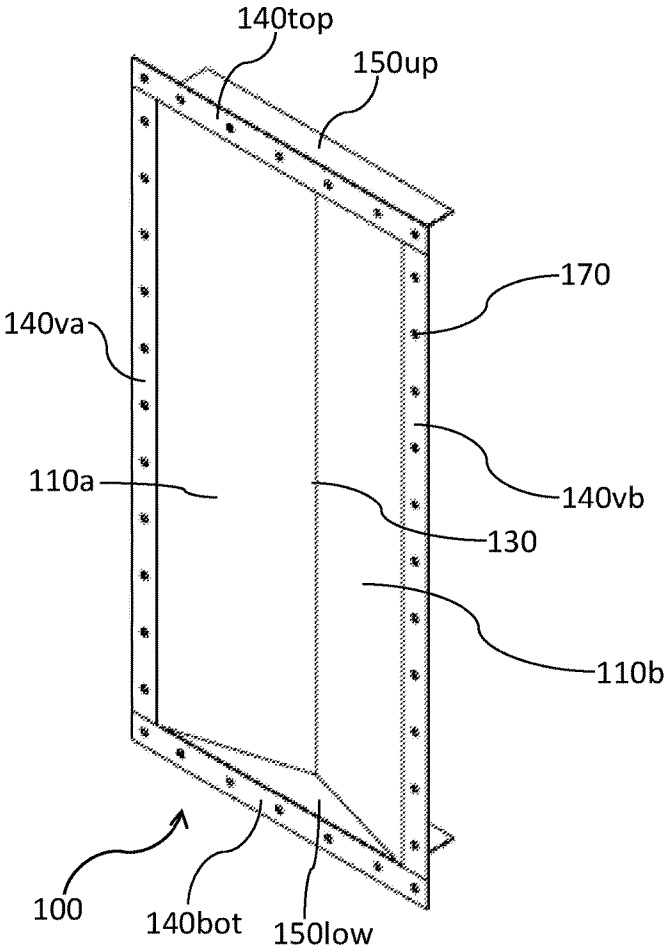
Figure 35:
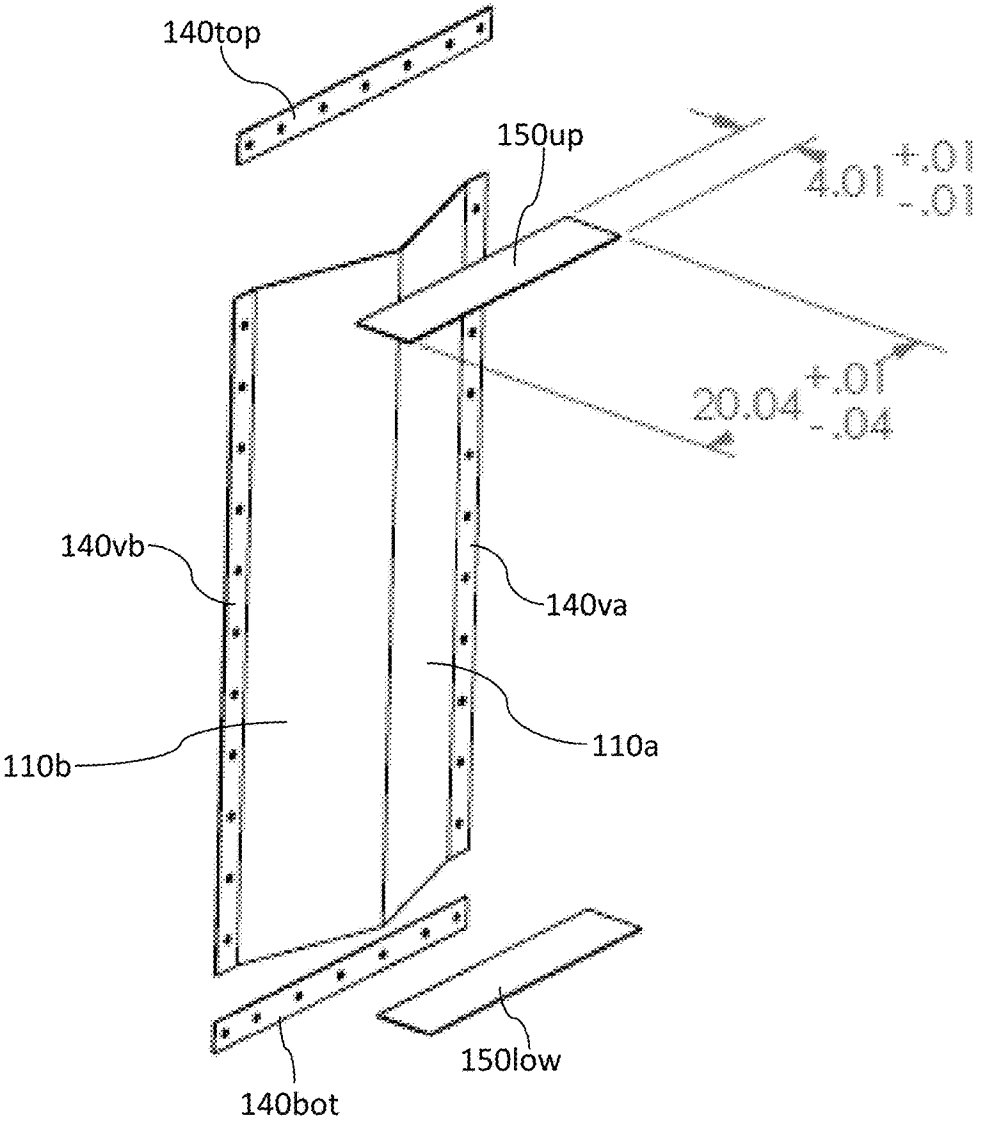
Figure 34:
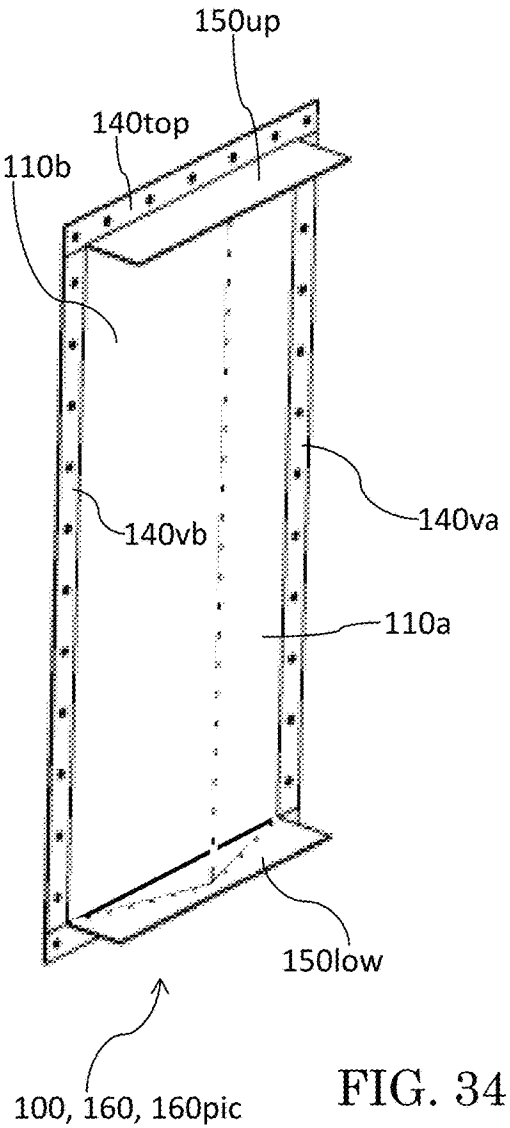

FIG. 31 illustrates an example of this kind of superior performance by an inventive V-shaped panel 100. Using the same flat wall plate 50, one would have to increase the thickness of the ¼-inch conventional plate 2.5 times (⅝ inch thick) to get the same performance as the inventive V-shaped panel, at the frequency identified as $f_{interest}$. Generally, in order to gain an increase in performance of a flat plate design, one must increase the thickness and/or change the material of the flat plate.

Hence, according to the example depicted in FIG. 31, the present invention's V-shaped wall panel 100 provides the performance of a flat wall plate structure 50, but with 2.5 times less weight associated with plate thickness. In terms of performance, the present invention's V-shaped wall panel provides over 30 dB given the same thickness of a conventional wall plate 50. In terms of weight, the inventive V-shaped wall panel is 2.5 times less heavy that the flat plate design of the same performance.

The present invention need not be practiced whereby both flat plates of the V-shaped wall panel have the same thickness and are made of the same material and have the same dimensions. Depending on the inventive embodiment, the respective thicknesses and/or materials and/or dimensions of the two joined plates can differ from each other. For instance, one plate of an inventive V-shaped wall panel can be larger (e.g., differ in height and/or breadth) or thicker than the other plate. Furthermore, the depth of the inventive V-shaped wall panel can be selected to suit the application. For an inventive V-shaped wall panel of a given width, the selected size of the flat panels will increase with increasing depth. Furthermore, the respective resonant frequencies of the flat panels will increase with increasing depth.

Figure 38:
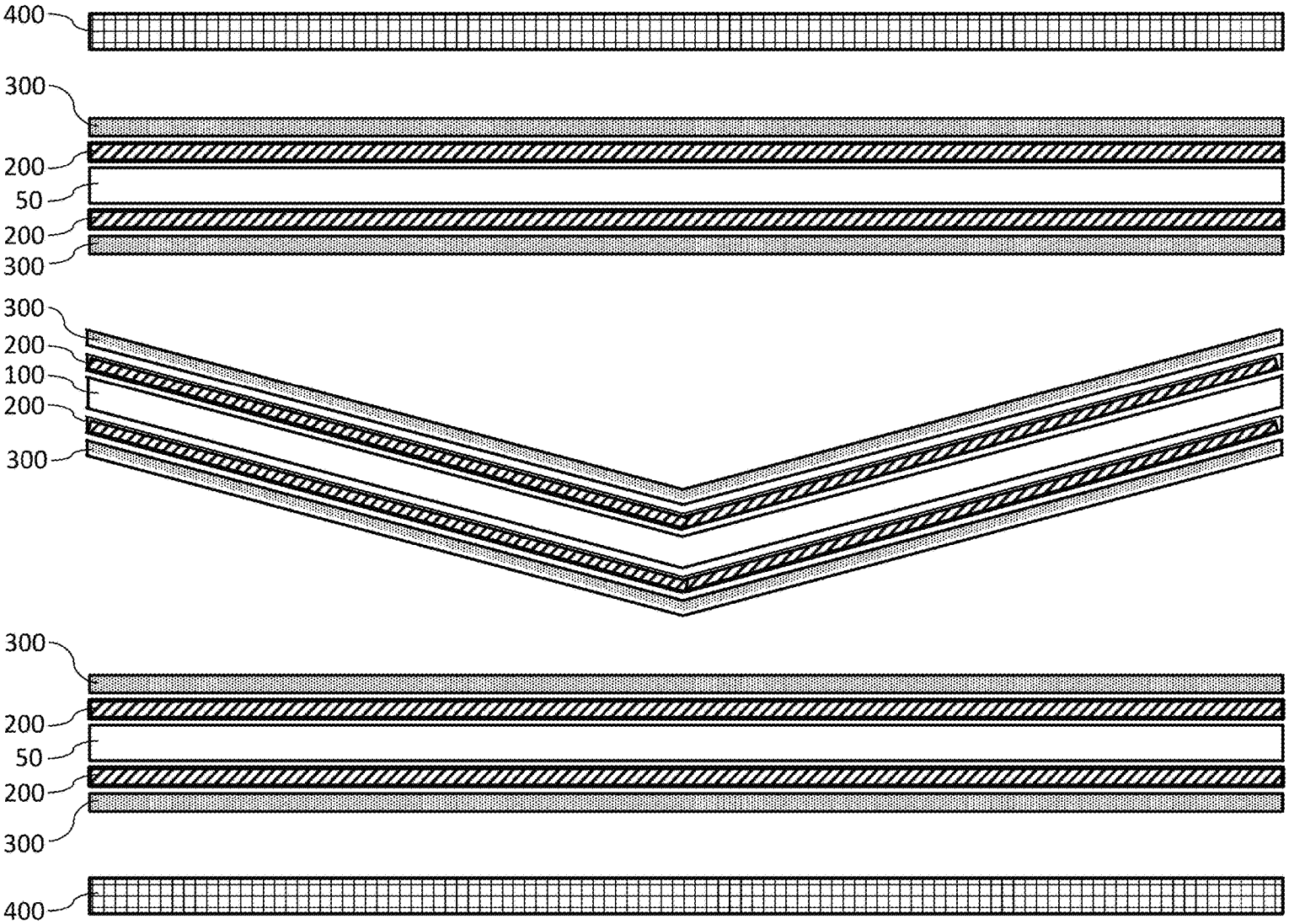
FIG. 38 is a diagram illustrating association of at least one damping material layer, at least one flat metal plate, and at least one perforated screen with an inventive V-shaped wall panel.
Figure 40:
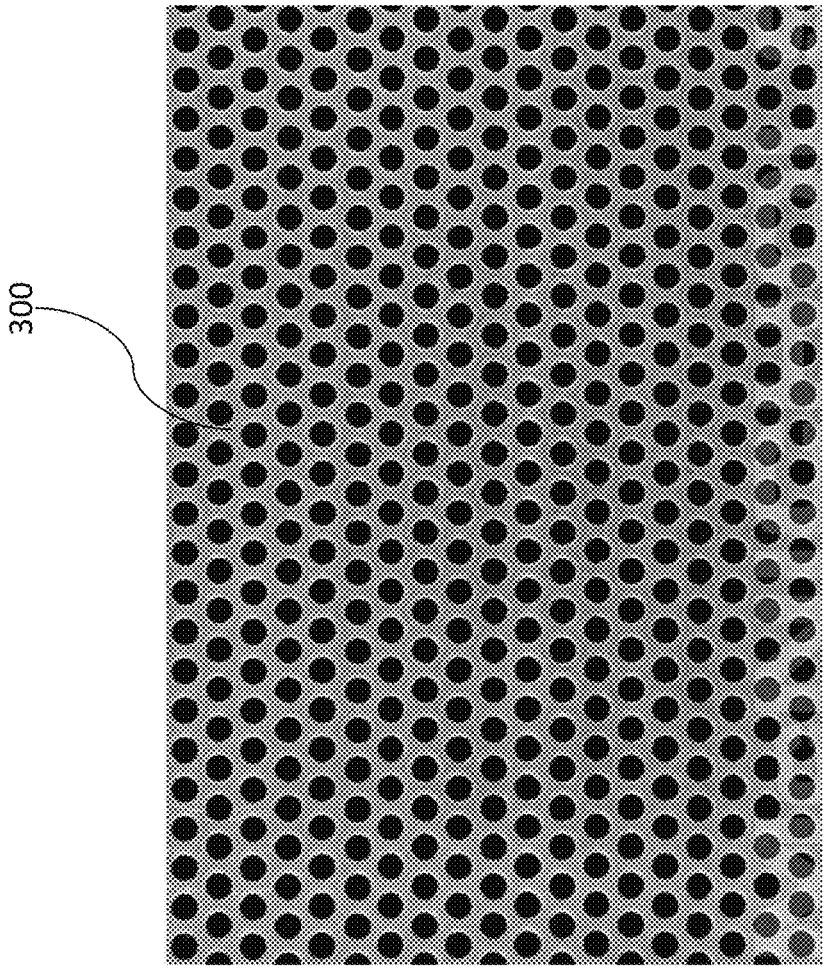
FIG. 40 is a plan view of an example of a perforated screen or a portion thereof.
Figure 39:
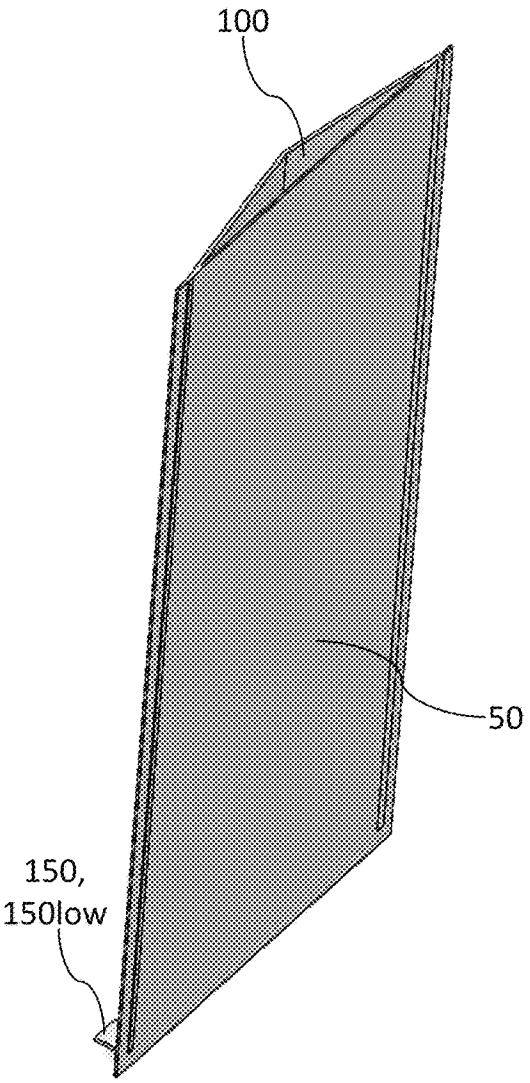
FIG. 39 is a perspective view of a combination including an inventive V-shaped wall panel and a flat panel.

With reference to FIGS. 38 through 40, inventive practice frequently includes additional structure or material to enhance the acoustic performance of an inventive panel 100. For example, a flat metal plate 50 (e.g., made of steel or aluminum) can be positioned in front of and/or in back of an inventive V-shaped wall panel 100. FIG. 38 illustrates possible inventive implementation, in association with an inventive V-shaped wall panel 100, of flat metal plate 50 and/or damping material 200 and/or sound-absorbing material 300 and/or perforated screen 400.

In inventive practice, a variety of combinations and configurations of one or more of these additional items may be used in association with an inventive V-shaped wall panel 100. For example, a metal plate 50 or a sound-absorbing material 300 or a perforated screen 400 can be placed adjacent to (e.g., contiguous or abutting) or spaced apart from another structure in the inventive assembly. In the light of the instant disclosure, the ordinarily skilled artisan will appreciate various types of metal plates, sound-damping materials, sound-absorbing materials, and/or perforated screens that may be suitable for inventive practice, and will also appreciate various arrangements and configurations of an inventive V-shaped wall panel 100 in association with one or more other structures and materials that may be suitable for inventive practice.

Structural damping material 200, such as a rubber, plastic, plastic composite, viscoelastic, or other elastomeric or polymeric material, can be adhered (e.g., bonded or glued) to any metal surface, such as on either or both sides of a flat metal plate 50, which is adjacent to an inventive panel 100, and/or on one or both flat plates 110 (e.g., each made of steel or aluminum), which are constituents of inventive panel 100. Damping material 200 absorbs structure-borne sound waves and thus reduces the structural motion of a structure such as a metal plate; this represents one of the ways to increase transmission loss.

Figure 4:
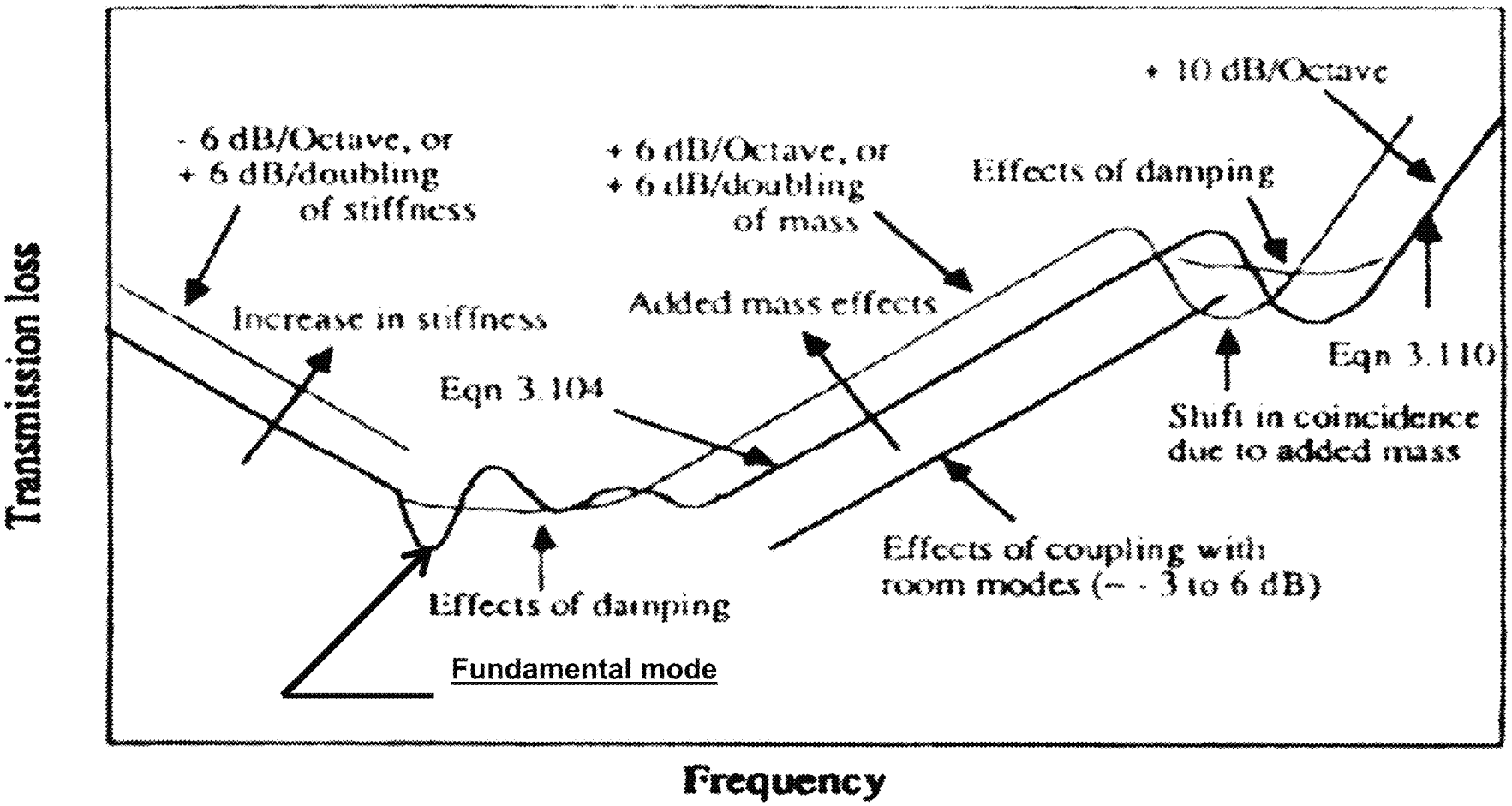
FIG. 4 is a graphical representation exemplifying how the fundamental mode of a flat plate affects its performance.

A damping material 200 can be adhered to one or both sides of a metal plate (e.g., sheet metal). Damping material that is adhered and exposed constitutes an unconstrained layer of damping material. Damping material can also be adhered as a constrained layer of damping material, such as between two metal plates in a sandwich construction. Damping material 200 may be beneficial insofar as smoothing out the first "big dip" in the transmission loss, such as illustrated in FIG. 4 by "Effects of damping."

A sound-absorbing material 300 (e.g., single or plural layers or structures made of fiberglass, mineral wool, or foam) may be used in inventive practice, in either adjacent or separated placement. Sound-absorbing material 300 may serve to absorb airborne sound waves. One or plural/multiple drywall (e.g., plasterboard, wallboard, or gypsum board) layers may be implemented to increase performance of an inventive assembly.

A perforated screen 400 (e.g., a perforated planar structure made of steel or other metal) may be positioned in front of and/or in back of an inventive panel 100, and may be positioned either adjacent to or separated from one or more other components of an inventive assembly. A perforated screen 400 may serve, for instance, to keep a sound-absorbing material 300 from coming out of an inventive assembly.

FIG. 39 shows an example of inventive integration of an inventive panel 100 with a flat panel 50 in front of the "V" opening of the inventive panel 100. A flat panel 50, such as covered on one or both sides with damping material 200, may be attached, for instance, to the housing 160 of an inventive V-shaped wall panel 100.

The present invention, which is disclosed herein, is not to be limited by the embodiments described or illustrated herein, which are given by way of example and not of limitation. Other embodiments of the present invention will be apparent to those skilled in the art from a consideration of the instant disclosure, or from practice of the present invention. Various omissions, modifications, and changes to the principles disclosed herein may be made by one skilled in the art without departing from the true scope and spirit of the present invention, which is indicated by the following claims.

What is claimed is:

1. An acoustic barrier comprising two flat rectangular structures meeting along a vertical demarcation to describe therebetween a right or obtuse angle, wherein each said flat rectangular structure is made of a material characterized by a sound transmission loss, and wherein said angle and the respective said materials of said two flat rectangular structures are selected to reduce sound transmission by inducing respective acoustic vibratory motions of said two flat rectangular structures that tend to counteract each other.

2. The acoustic barrier of claim 1, further comprising a housing for said two flat rectangular structures, said two flat rectangular structures attached to each other along said vertical demarcation, said housing maintaining said two flat rectangular structures at said angle.

3. An acoustically attenuative wall panel comprising two vertical rectangular plates, each said vertical rectangular plate having two vertical edges, said two vertical rectangular plates connected along two respective said vertical edges and forming an angle between said two vertical rectangular plates in the range of at least ninety degrees and less than one hundred eighty degrees, wherein when the wall panel faces a sound source the two connected vertical rectangular plates vibrate at opposite phases from each other, whereby sound transmission is reduced.

4. The acoustically attenuative wall panel of claim 3 further comprising a lower structural member and an upper structural member, each said vertical rectangular plate having a lower horizontal edge and an upper horizontal edge, said lower structural member attached to said two vertical rectangular plates along the respective said lower horizontal edges of said two vertical rectangular plates, said upper structural member attached to said two vertical rectangular plates along the respective said upper horizontal edges of said two vertical rectangular plates.

5. The acoustically attenuative wall panel of claim 4, wherein said lower structural member and said upper structural member are each horizontally planar.

6. The acoustically attenuative wall panel of claim 5, said lower structural member and said upper structural member being vertically aligned, said lower structural member characterized by a lower member width, said upper structural member characterized by an upper member width that equals said lower member width, said two vertical rectangular plates characterized by a horizontal expanse that equals said upper member width and said lower member width, said two vertical rectangular plates adjoining said lower structural member within said lower member width and said upper structural member within said upper member width.

7. The acoustically attenuative wall panel of claim 6 further comprising a vertical planar frame generally circumscribing said two vertical rectangular plates.

8. The acoustically attenuative wall panel of claim 7, said vertical planar frame having a lower frame portion and an upper frame portion, said lower structural member attached to said vertical planar frame on said lower frame portion, said upper structural member attached to said vertical planar frame on said upper frame portion.

9. The acoustically attenuative wall panel of claim 3 further comprising a rectangular box-shaped frame having a bottom horizontal planar section and a top horizontal planar section, each said vertical rectangular plate having a lower horizontal edge and an upper horizontal edge, said bottom horizontal planar section attached to said two vertical rectangular plates along the respective said lower horizontal edges of said two vertical rectangular plates, said top horizontal planar section attached to said two vertical rectangular plates along the respective said upper horizontal edges of said two vertical rectangular plates.

10. The acoustically attenuative wall panel of claim 9, wherein said bottom horizontal planar section and said top horizontal planar section are each horizontally planar.

11. The acoustically attenuative wall panel of claim 10, said lower structural member and said upper structural member being vertically aligned, said lower structural member characterized by a lower member width, said upper structural member characterized by an upper member width that equals said lower member width, said two vertical rectangular plates characterized by a horizontal expanse that equals said upper member width and said lower member width, said two vertical rectangular plates adjoining said lower structural member within said lower member width and said upper structural member within said upper member width.

12. The acoustic barrier of claim 1, formed by bending a single flat plate along a vertical linear demarcation.

13. The acoustic barrier of claim 12, further comprising a housing thereby forming a wall panel.

14. A plurality of acoustic barriers of claim 13, wherein the wall panels are arranged to form a wall.

15. The acoustically attenuative wall panel of claim 3 wherein the two vertical plates are formed by bending a single flat plate along a vertical linear demarcation.

16. A plurality of acoustically attenuative wall panels of claim 15, wherein the wall panels are arranged to form a wall.

17. A plurality of acoustically attenuative wall panels of claim 3, wherein the wall panels are arranged to form a wall.

* * * * *